US005096564A

United States Patent [19]

Jowitt et al.

[11] Patent Number: 5,096,564

[45] Date of Patent: Mar. 17, 1992

[54] ELECTRO-COATING APPARATUS AND METHOD

[75] Inventors: Frederick W. Jowitt; Robert H. Harrison; Keith West; Kevin J. Pope; Adrian C. Noke, all of Oxfordshire, United Kingdom

[73] Assignee: CMB Foodcan plc, England

[21] Appl. No.: 576,115

[22] Filed: Aug. 27, 1990

Related U.S. Application Data

[63] Continuation of Ser. No. 193,452, May 6, 1988, abandoned.

[30] Foreign Application Priority Data

Jun. 26, 1987 [GB] United Kingdom ..... PCT/GB87/00452

Jul. 7, 1986 [GB] United Kingdom ..... 8616514

[51] Int. Cl.[5] ..... B01D 61/42; C25D 13/00

[52] U.S. Cl. ..... 204/299 EC; 204/300 EC

[58] Field of Search ..... 204/180.2, 180.7, 299 EC, 204/300 EC

[56] References Cited

U.S. PATENT DOCUMENTS

| | | | |
|---|---|---|---|
| 2,448,117 | 8/1948 | Pearson | 204/200 |
| 3,849,284 | 11/1974 | Kossmann | 204/300 |
| 3,922,213 | 11/1975 | Smith et al. | 204/181 |
| 3,969,136 | 7/1976 | Miskech | 134/48 |
| 4,094,760 | 6/1978 | Smith et al. | 204/300 EC |
| 4,246,088 | 1/1981 | Murphy et al. | 204/300 EC |
| 4,400,251 | 8/1983 | Heffner et al. | 204/300 EC |
| 4,452,680 | 6/1984 | Jackson et al. | 204/300 EC |
| 4,529,492 | 7/1985 | Buchholz et al. | 204/300 EC |
| 4,544,475 | 10/1985 | Heffner et al. | 204/300 EC |
| 4,676,881 | 6/1987 | Davidson | 204/300 EC |

FOREIGN PATENT DOCUMENTS

| | | |
|---|---|---|
| 455810 | 7/1935 | United Kingdom . |
| 1498795 | 3/1974 | United Kingdom . |
| 1604035 | 11/1977 | United Kingdom . |
| 2001348 | 7/1978 | United Kingdom . |
| 2085474 | 10/1980 | United Kingdom . |

*Primary Examiner*—John Niebling
*Assistant Examiner*—Steven P. Marquis
*Attorney, Agent, or Firm*—Diller, Ramik & Wight

[57] ABSTRACT

In a high speed electro-coating apparatus having a plurality of electro-coating cells arranged around the periphery of a rotable turntable, each can is placed upright on a cell lid below a hollow cell body and is introduced into that body by upward movement of the cell lid. Separate simultaneous flows of electro-coating fluid fill and immerse the can, and each cell receives electro-coating current via slip-ring segments carried on the turntable past respective sets of brushes which are disposed at the respective electro-coating stations. Control apparatus is arranged to feed current to the brush sets only during the periods of turntable rotation during which each brush has full contact with an adjacent slip-ring segment. An infeed device has a rotable turret from which radiate a plurality of can holders which act to transfer cans from a screw-type infeed conveyor along an encircling guide rail to an infeed station of the apparatus. Camgear enclosed in the turret cyclically retracts each holder as it approaches the infeed station so as to cause each can to follow there in concert with the guide rail the locus of a cell arriving to receive the can from the infeed device. An outfeed device has a rotatable turret from which radiate a plurality of can grippers each of which is arranged to grip a can delivered to it at an outfeed station of the apparatus and then to rotate the can so as to empty fluid still remaining in it before releasing it in the inverted condition to an outfeed conveyor.

19 Claims, 22 Drawing Sheets

196
198
200
202
142
158
174
154
192
152
156
94
172
138
148
168
162
140
170
164
166
250
180
244
160
16
144
176
128
178
226
228
146
177
182
186
194
188
184
150
212
240
123
132
210
208
204
100
130
115
190
124
238
206
126
134
136
212

38
42
390
40
306
272
274
276
382
389
280
254
304
174
186
158
318
316
324
282
314
258
260
262
266
36
268
310
264
256
308
202
106
108
110
270
320
316
284
34
278
285
288
290
292

390
272
392
254
388
386
382

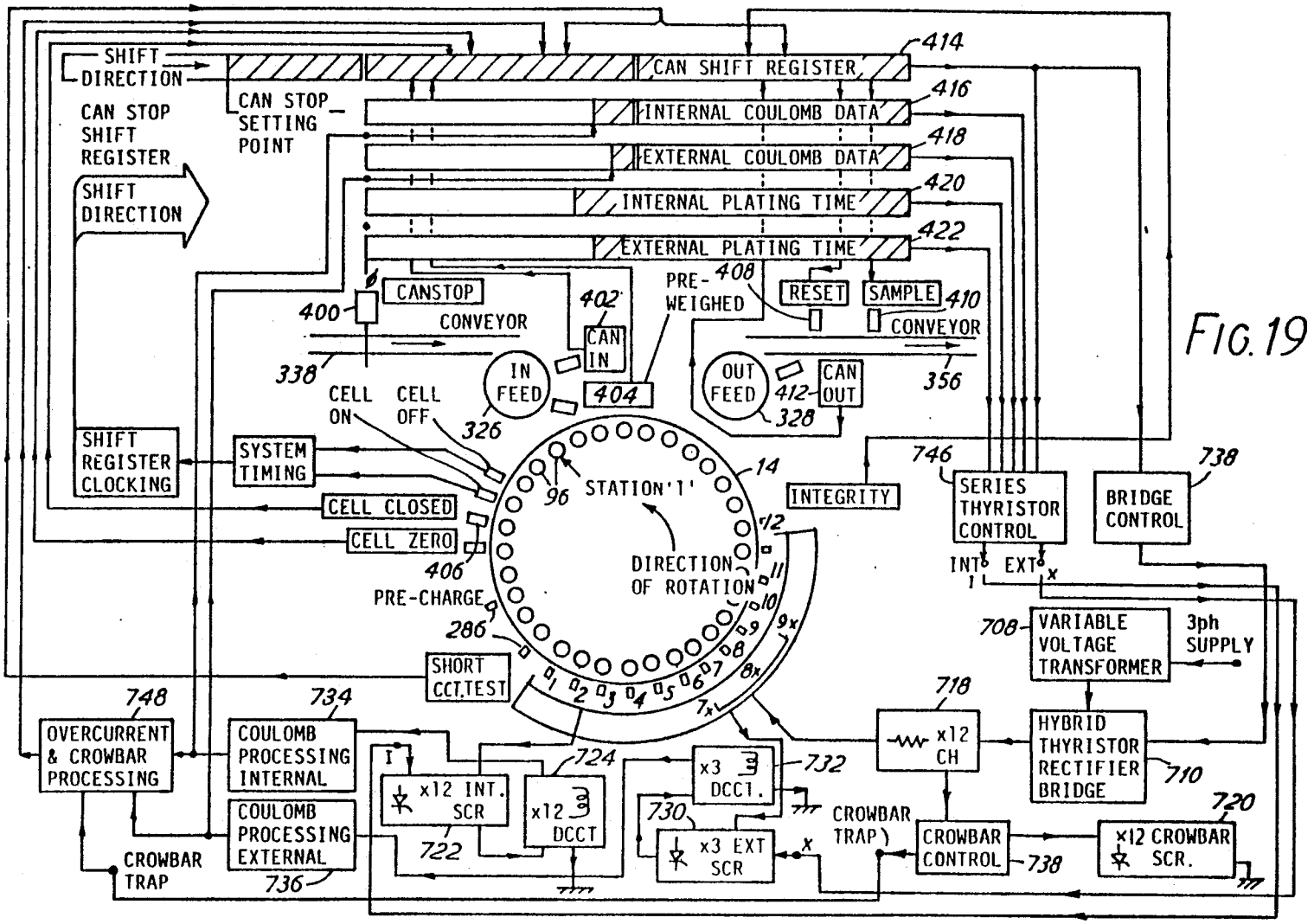
FIG. 19
BRIDGE CONTROL
738
3ph SUPPLY
VARIABLE VOLTAGE TRANSFORMER
708
HYBRID THYRISTOR RECTIFIER BRIDGE
710
x12 CROWBAR SCR.
720
SERIES THYRISTOR CONTROL
746
INT
EXT
CROWBAR CONTROL
738
x12 CH
718
CROWBAR TRAP
INTEGRITY
CAN SHIFT REGISTER
414
INTERNAL COULOMB DATA
416
EXTERNAL COULOMB DATA
418
INTERNAL PLATING TIME
420
EXTERNAL PLATING TIME
422
SAMPLE
410
CONVEYOR
356
RESET
408
CAN OUT
412
328
OUT FEED
PRE-WEIGHED
14
STATION '1'
DIRECTION OF ROTATION
x3 DCCT.
732
x3 EXT SCR
730
CAN IN
402
404
IN FEED
326
96
x12 DCCT
724
CANSTOP
CONVEYOR
CELL OFF
CELL ON
CELL CLOSED
CELL ZERO
406
PRE-CHARGE
286
SHORT CCT.TEST
x12 INT. SCR
722
400
338
SYSTEM TIMING
COULOMB PROCESSING INTERNAL
734
COULOMB PROCESSING EXTERNAL
736
CAN STOP SETTING POINT
SHIFT DIRECTION
CAN STOP SHIFT REGISTER
SHIFT DIRECTION
SHIFT REGISTER CLOCKING
OVERCURRENT & CROWBAR PROCESSING
748
CROWBAR TRAP

ELECTRO-COATING APPARATUS AND METHOD

This application is a continuation of application Ser. No. 07/193,452, filed May 6, 1988, and now abandoned.

TECHNICAL FIELD

This invention relates to an apparatus for and a method of treating at least an internal surface or an external surface of a cup-shaped container, particularly by an electro-chemical process, such as, for example, an electro-phoretic coating process for providing a synthetic protective coating on such surface. In an electrophoretic process, a metal surface to be coated is disposed adjacent but spaced from an electrode of suitable shape; the space between that surface and the electrode is filled with an electro-phoretic coating liquid in which particles of the material to be electro-deposited are carried in a suitable electrolyte; and a d.c. voltage is applied between that metal surface and the electrode so as to cause the migration of those particles of material to that metal surface under the influence of the applied electric field. Such process has been used to protectively coat surfaces of metal cup-shaped containers, such as food- or beverage-containing metal cans.

BACKGROUND ART

It is known:

(a) to treat a surface of a cup-shaped container by bringing a suitable fluid into contact with such surface;

(b) to electro-phoretically coat a surface of a metal, cup-shaped container by bringing an electro-coating liquid into contact with the surface and simultaneously applying an electric potential between that surface and an adjacent electrode;

(c) to electro-phoretically coat an internal surface only of a metal cup-shaped container by means of a static body of electro-coating liquid disposed between the upright container (open and uppermost) and an internal electrode which has been lowered into a predetermined charge of such liquid present in the container until the displaced liquid contacts the whole of the interior surface to be coated (Patent specification GB 455,810, Crosse & Blackwell Ltd., published 1936);

(d) to electro-phoretically coat an interior surface only of an un-enclosed, inverted, metal cup-shaped container by means of a flowing electro-coating liquid which is brought into contact with that surface by causing it to issue upwards from an internal electrode nozzle on to the interior surface of the base portion of the inverted container and to flow thence downwardly in the space between the interior surface of the container side wall and internal electrode U.S. Pat. No. 3,922,213, Aluminium Company of America, published 1975);

(e) to treat (e.g. clean in preparation for filling) a cup-shaped container both internally and externally in the same operation by enclosing the container in an upright position in a cell with small clearance between the surfaces of the container and the respective adjacent surfaces of the cell structure, the cell having in one embodiment a loose, hinged and apertured base member (or lid) to enable the container to be introduced from below, and in the principal embodiment two vertically slidable and engageable cell body halves to enable the container to be introduced horizontally from the side, the treating operation being carried out solely by means of a high speed turbulent fluid flowing downwardly to the internal base surface and thence in succession over both of the internal and external surfaces of the container to exit through the aperture in the cell base member, and without any electrical energisation of such fluid (U.S. Pat. No. 3,969,136, Oxy Metal Industries Corporation, published 1976);

(f) to treat (e.g. clean in preparation for filling) a cup-shaped container both internally and externally in the same operation by enclosing the container in an inverted position in a cell with small clearance between the surfaces of the container and the respective adjacent surfaces of the cell structure; which structure comprises a cell body into which the inverted container is drawn by suction, and a loose lid which is removable vertically and angularly, the lid being disposed at the upper end or the lower end of the cell body, and the treatment being carried out by flowing the treatment liquid successively over both of the internal and the external surfaces of the container (in either direction) in such manner as to produce turbulence and so enhance the cleaning action of the liquid, but without any electrical energisation of the liquid (Patent specification GB 1,498,795, Jackson, published 1978);

(g) to electro-phoretically coat a cup-shaped container both internally and externally in the same operation by enclosing the container in an inverted position in a cell with small clearance between the surfaces of the container and the respective adjacent (electrode) surfaces of the cell structure, which structure comprises vertically separable cell body and cell lid portions, the lid portion being lowermost and receiving on it the open end of the inverted container, and the electrocoating process being carried on by flowing the coating liquid successively over both of the internal and the external surfaces of the container in either direction (U.S. Pat. No. 4,094,760, Aluminium Company of America, published 1978, and corresponding GB 2,001,348, published 1979);

(h) to electro-phoretically coat a cup-shaped container both internally and externally in the same operation by enclosing the container in an inverted position in a cell with small clearance between the surfaces of the container and the respective adjacent (electrode) surfaces of the cell structure, which structure comprises a cell comprising vertically separable cell body and cell lid portions, the lid portion being uppermost and closing the upper open end of the cell body portion, and the electro-coating being carried on by flowing the coating liquid successively over both of the external and the internal surfaces of the container (Patent specification GB 1,604,035, Metal Box plc, published 1981); and (i) to electro-phoretically coat the internal surface and the external base surface of a cup-shaped container by enclosing the container in the inverted position in a cell with small clearance between those internal and external surfaces and their respective adjacent (electrode) surfaces of the cell structure, which structure comprises vertically separable cell body and cell lid portions, the lid portion being uppermost and closing the upper open end of the cell body portion, and the electro-coating being carried on by simultaneously flowing the coating liquid in parallel over the internal surface and the external base surface of the container (Patent specification GB 2,085,474 B, Metal Box plc, published 1982).

In the upright container arrangement referred to at (c) above (GB 455,810—electro-coating the internal surface only) and at (e) above (U.S. Pat. No. 3,969,136—treating non-electrically both internal and external surfaces), the cup-shaped container of (c) above has to be turned upside down to remove the charge of electro-coating fluid, whilst in the arrangement of (e) above, the treatment fluids are removed by the subsequent high speed passage of high pressure purging air.

In the arrangement referred to at (h) above (GB 1,604,035), at the high liquid flows required to fill an empty the inter-cell and container passages in the time available, small variations in the flow rate which occurred at some parts of the flow passages led to the formation of voids in the coating liquid, with the result that some areas of the surfaces to be coated were left uncoated. Furthermore, the use of high speed compressed air to expel the coating liquid from those passages after coating had been completed and to eject the container from the cell body has led to excessive foaming of the coating liquid circulating in the cell (and could lead to an excessive build-up of foam in the coating liquid circulation system), and to the presence of foam on some surface parts of the ejected container which foam is difficult to remove during subsequent rinsing and which can therefore give rise to surface defects in the film produced by thermally curing the electro-coating material.

The present invention seeks to provide a method of electro-coating a cup-shaped container, which method (1) avoids the difficulties experienced with that prior art electro-coating apparatus and (ii) enables (a) the electro-coating of can bodies at very high through-puts, e.g. of the order of six hundred cans per minute, (b) the production of electro-coated can bodies which are consistently and uniformly coated to a very high standard for all through-put rates within the design range of the apparatus, and (c) the production of can bodies at a through-put rate which is variable to suit the conditions prevailing in the can body production and processing line of which the electro-coating apparatus forms part. The invention also seeks to provide an apparatus for enabling the improved electro-coating method of the present invention to be successfully carried out.

DISCLOSURE OF THE INVENTION

According to one aspect of the present invention, an electro-coating apparatus for electro-coating a surface of a metal container such as a can body comprises an apparatus of the kind having a cell comprising a hollow cell body to surround the container; a lid to close the cell; a mandrel means to introduce electrolyte into contact with the container; and means to impose an electrical potential difference between the container and at least one cell member whereby to electro-coat a container surface disposed adjacent said cell member, and said apparatus is characterised in that said cell lid is disposed at the bottom of said cell body, and said container is held mouth upwards in said cell while an electrical potential difference is applied.

According to another aspect of the present invention, a method of electro-coating a surface of a metal container comprises the steps of: (a) mounting such a container upright on a cell lid and below a hollow cell body which incorporates within it a central tubular mandrel; (b) effecting relative movement of the cell body and cell lid towards one another so as to introduce the container wholly into the hollow cell body, and to close the cell lid to the lower end of the cell body in a fluid tight manner, with the mandrel then projecting into the container almost to, but spaced from, the base wall of the container; (c) circulating an electro-coating fluid through the tubular mandrel into the container, and exhausting that fluid from around the mandrel at the upper, open end of the container; and (d) applying an electro-coating potential between the tubular mandrel and the container in a predetermined manner whereby to electro-coat the internal surface of the container.

Such a method may also include the step of simultaneously circulating additional electro-coating fluid through passageways formed in said cell lid and then over the external surfaces of the base and side walls of said container, and exhausting said additional electro-coating fluid from around the upper end of the side wall of the container; and if desired, of applying an electro-coating potential in a predetermined manner between the container and a tubular electrode which is carried in said cell body concentrically around said container, whereby to electro-coat the external surface of the container.

The application of said electro-coating potential between said container and the surrounding electrode is preferably delayed until the electro-coating current flowing between the container and the mandrel has fallen to a low value.

The electro-coating potential is preferably applied in a pulsed manner.

Advantageously, the cell is carried around on a rotatable turntable through a series of consecutive electro-coating stations, and said pulses are applied successively as the cell is carried by said turntable through successive electro-coating stations respectively.

Other features of the present invention will appear from a reading of the description that follows hereafter and of the claims appended at the end of that description.

One electro-coating apparatus embodying the present invention, and its method of operation, and various modifications of such apparatus and method (all according to the present invention), will now be described by way of example and with reference to the accompanying diagrammatic drawings.

BRIEF DESCRIPTION OF THE DRAWINGS

In those drawings:

FIG. 2(*b*) shows an enlarged vertical diametral cross-section taken through a cell closer which is shown in FIG. 2(*a*);

FIG. 19 shows schematically the turntable in relation to (a) various associated monitoring and control devices, and (b) various electrical monitoring and control items and stages that are variously executed in hardware and/or software form.

BEST MODES OF CARRYING OUT THE INVENTION

Figure 1:
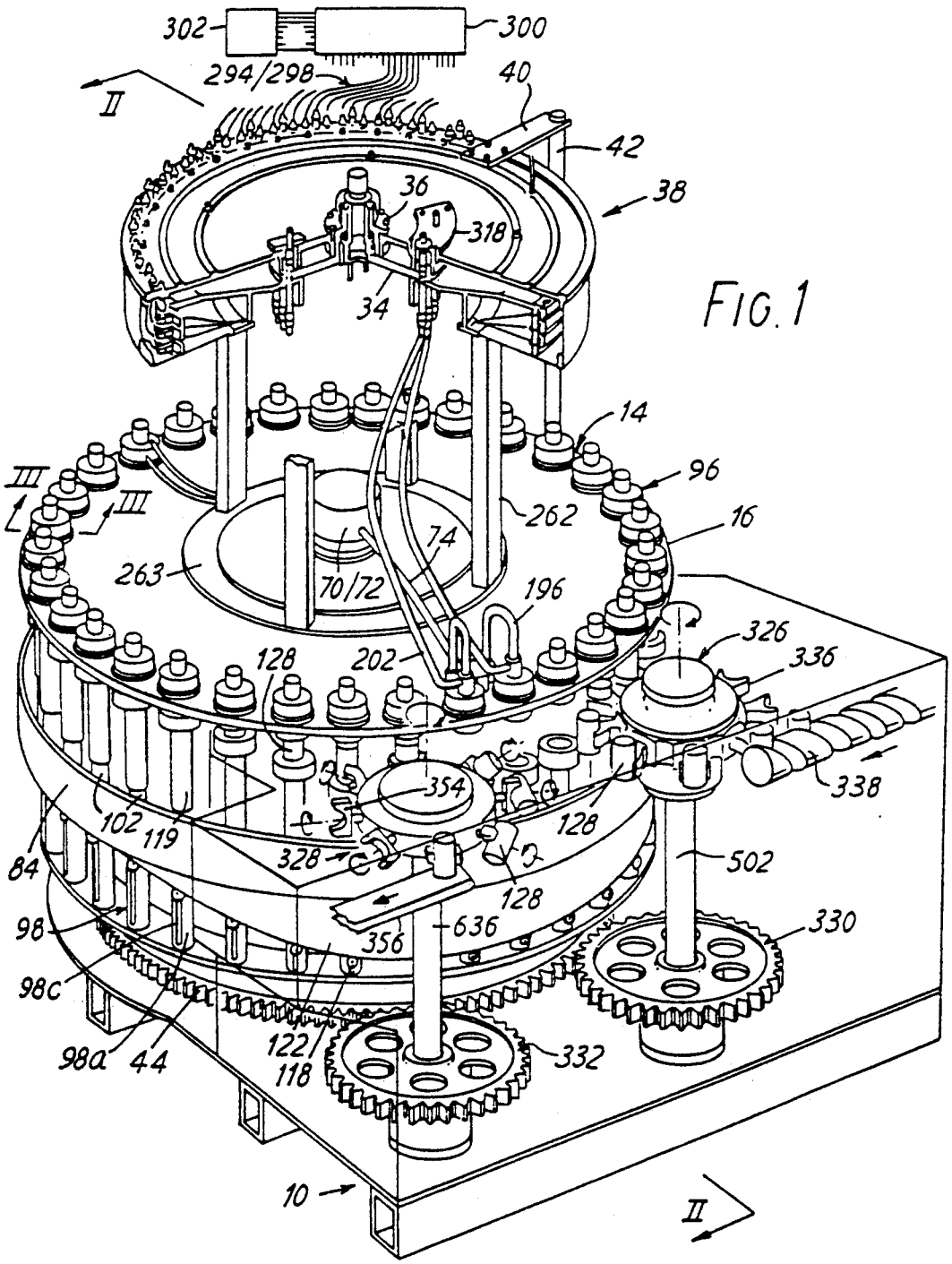
FIG. 1 shows a pictorial representation of the electro-coating apparatus.
Figure 2A:
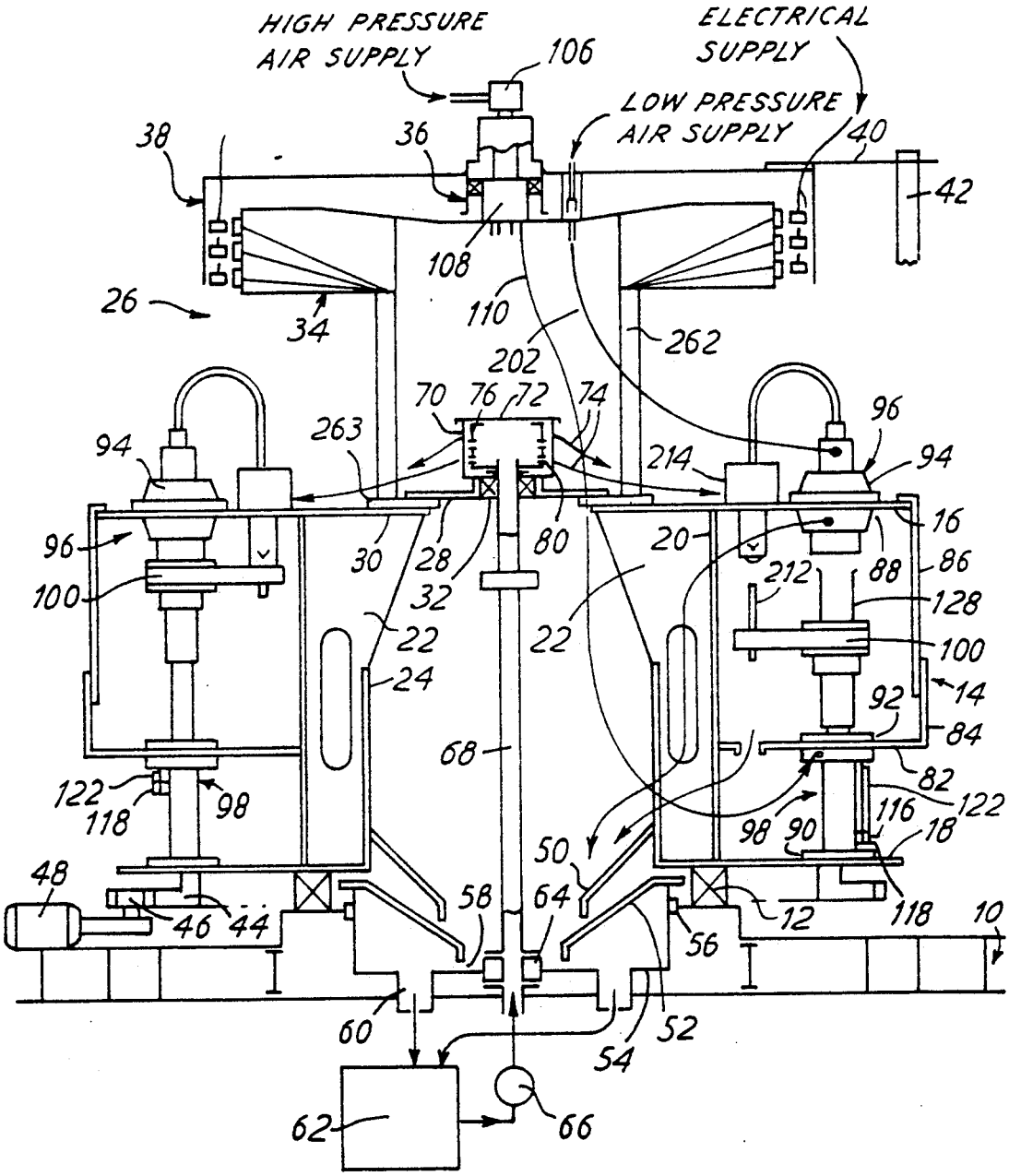
FIG. 2(*a*) shows diagrammatically a vertical cross-section taken on the diametral plane II—II (indicated in the FIG. 1) of a turntable incorporated in such apparatus.
Figure 2B:
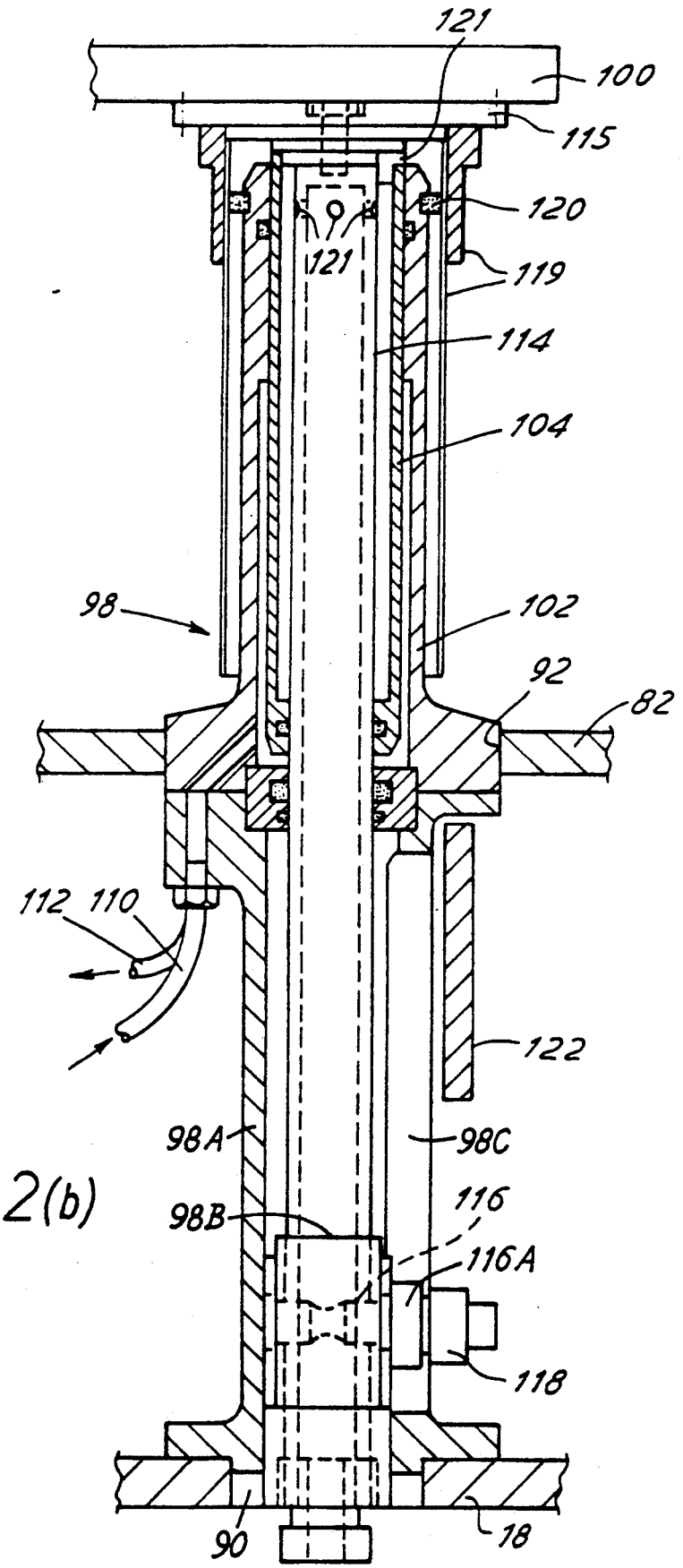

Referring now to the drawings, particularly to the FIGS. 1 to 2, the apparatus there shown comprises a static base structure 10* which carries on a bearing 12* a rotatable turntable or drum unit 14*. (In this specification, an asterisk shown in association with a reference number indicates a first mention of that reference number.) The drum unit includes upper and lower annular plates 16*, 18* spaced apart vertically by an outer cylindrical wall 20*, a plurality of circumferentially spaced, apertured, radial webs 22*, and an inner cylindrical wall 24*.

The upper annular plate 16 carries centrally, for rotation therewith, a superstructure 26* which includes lowermost a bearing plate 28* seated on and secured to the inner peripheral parts 30* of the upper annular plate 16. That bearing plate supports centrally a bearing 32* whose purpose will become apparent later, and above it a slip-ring unit 34*. The latter carries uppermost, on a central bearing unit 36*, a brush-gear unit 38* which shrouds the slip-ring unit, and which is held against rotation by a torque arm 40* which engages a fixed post 42* carried on the base structure 10.

The lower annular plate 18 of the drum unit carries beneath it a toothed gear ring 44* with which a driving gear pinion 46* engages. A geared driving motor 48* carried on the base structure 10 is coupled to, and drives when energised, that gear pinion.

Secured within the inner cylindrical wall 24 of the drum unit 10 is a funnel member 50* which lies above and overlaps the outer peripheral parts of a stationary funnel member 52* which is secured to the upper part of a cylindrical fluid collector pan 54* which is itself carried around its girth on supporting parts 56* formed on the base structure 10.

The collector pan has formed in its base plate 58* a plurality of fluid exit holes 60* for enabling fluid collecting in the pan to flow away to a fluid reservoir tank 62*. That base plate also carries a central collar 64* to which is secured, on its lower side, the delivery pipe of a pump 66* which is arranged to draw its intake fluid from the reservoir tank 62, and on the upper side thereof, the bottom end of a vertically-disposed fluid supply tube 68*. That tube is steadied at its upper end in, and extends through, the bearing 32 supported in the bearing plate 28.

Extending upwardly from that bearing plate and sealed around the bearing 32 is an upwardly extending cylindrical wall 70* which is closed at its upper end by a removable cover plate 72* and constitutes a stationary fluid distribution chamber. A series of radial ports formed in that cylindrical wall have secured therein the respective ends of a plurality of fluid feed pipe 74*. The flow of fluid to those pipes is controlled by a stationary cylindrical baffle 76* which is secured to the upper end of the vertical supply tube 68 and which has formed in its cylindrical wall (unnumbered) a series of graduated ports 80* for effecting variation of the flow of fluid to the respective feed pipes 74 as the drum units 14 revolves around its vertical axis through successive predetermined angular positions relative to the baffle.

The drum unit 14 also incorporates an intermediate annular plate 82* which is sealed to the cylindrical wall 20 and which carries externally an upstanding wall 84*. A static cylindrical shield 86*, carried in the base structure 10, overlaps at its upper end the periphery of the upper annular plate 16, and overlaps at its lower end the upper peripheral parts of the cooperating upstanding wall 84, so as to prevent the escape of fluid from the annular region enclosed by the shield 86.

The upper, lower and intermediate annular plates 16, 18 and 82 of the drum unit 14 have formed therein respective sets of thirty-two circumferentially-spaced, circular apertures 88*, 90* and 92* (indicated in the FIG. 2). Corresponding apertures of the respective sets are disposed in vertical alignment one with another.

The upper annular plate 16 carries in each of its said apertures 88 a vertically-dependent body portion 94* of an electro-coating cell 96*. The lower annular plate 18 supports in each of its said apertures 90 a vertically-upstanding cell closing actuator 98* (referred to later as a "cell closer"), at the upper, movable end of which is carried a cell closure member 100* (referred to later as a "cell lid").

The cell closer extends upwardly through the corresponding aperture 92 formed in the intermediate plate 82, and is located there by that aperture, so that on energisation of the cell closing actuator 98 by high pressure air the cell lid 100 is raised into a position in which it abuts the lower end of the cell body 94 and so closes off and thus completes the cell 96.

Each cell closer 98 incorporates a cylinder 102* secured on the intermediate annular plate 82 (see FIG. 2(*b*)), in which cylinder a cooperating elongated, tubular piston 104* is vertically movable. That piston is urged upwardly by air supplied continuously to the cylinder 102 at a suitable high constant pressure from a supply source (not shown) via a rotatable air coupling 106*, a distribution manifold 108* secured in the central upper part of the slip-ring unit 34, and a feed pipe 110*.

The respective cell closer cylinders 102 are all connected together by respective interconnecting pipes 112*, each of which interconnects a pair of adjacent cylinders. The ring-like pneumatic system so formed is connected at four equi-spaced positions thereon, through four said feed pipes 110, with said distribution manifold 108, so that all of the cylinders are constantly energised by a supply of high pressure air.

In each cell closer 98, a tubular piston rod 114* is connected at its upper end to a lid-receiving socket plate 115*, which is also secured to the upper end of the elongated piston 104, and carries near its lower end (remote from the cell lid) a transverse stud 116* on which is carried rotatable cam follower wheel 118*.

Between the intermediate and lower annular plates 82 and 18 of the turntable 14, each cell closure 98 comprises a tubular guide 98A (FIG. 2(*b*)) in which a slide block 98B carried on the lower end of the piston rod 114 is arranged to slide vertically. The tubular guide 98A has in its side wall a vertically disposed longitudinal slot in which rides a cam follower wheel 116A carried by the transverse stud 116.

A protective cylindrical shroud 119* secured at its upper end to the socket plate 115 encircles the cylinder 104. The upper end of that cylinder carries an electro-coating fluid excluding sealing ring 120* which cooperates with the shroud to enclose the space above that ring. Breathing apertures 121* are provided in the upper ends of the tubular piston 104 and the tubular piston rod 114 so as to enable that enclosed annular space (confined between the upper end of the piston 104 and the shroud 119) to breath, on movement of the piston and piston rod in the cylinder, via the lower open end of the tubular piston rod 114, which end communicates with a dry area of the apparatus.

Supported from the base structure 10 is an arcuate cam member 122* which is positioned below the intermediate annular plate 82, and lies radially adjacent the lower parts of the respective cell closers 98, so as to cooperate with and position the respective cam follower wheels 118 as the cell closers are carried around by the drum unit 14 into and through a predetermined range of angular position relative to the base structure 10.

The vertical depth of that cam member varies progressively in a manner such as to cause each cell closer piston rod 114 in turn, as the drum unit rotates through said range of angular positions, to be lowered (as a result of an increasing depth of the cam member and in opposite to the biassing force provided by the high pressure air supplied to the cell closers) to its lowermost position, and then to be raised again to its uppermost position under the biassing action of the high pressure air supplied to the cell closers and in accordance with a decreasing depth of the cam member.

Figure 3:
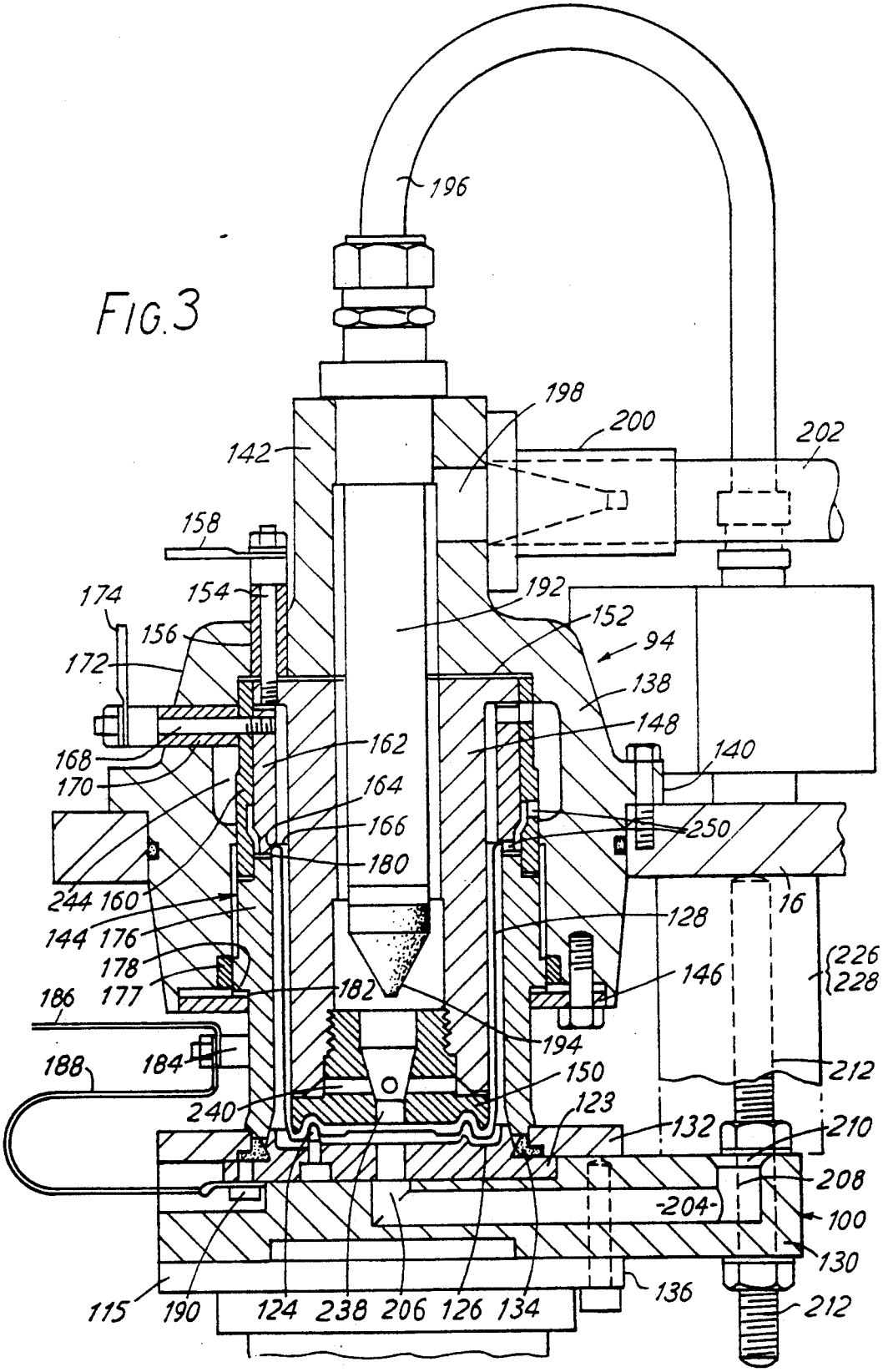
FIG. 3 shows diagrammatically a vertical cross-section taken on a radial plane III—III (indicated in the FIG. 1) of the turntable, and showing the internal construction of one of several electro-coating cells carried on that turntable.
Figure 4:
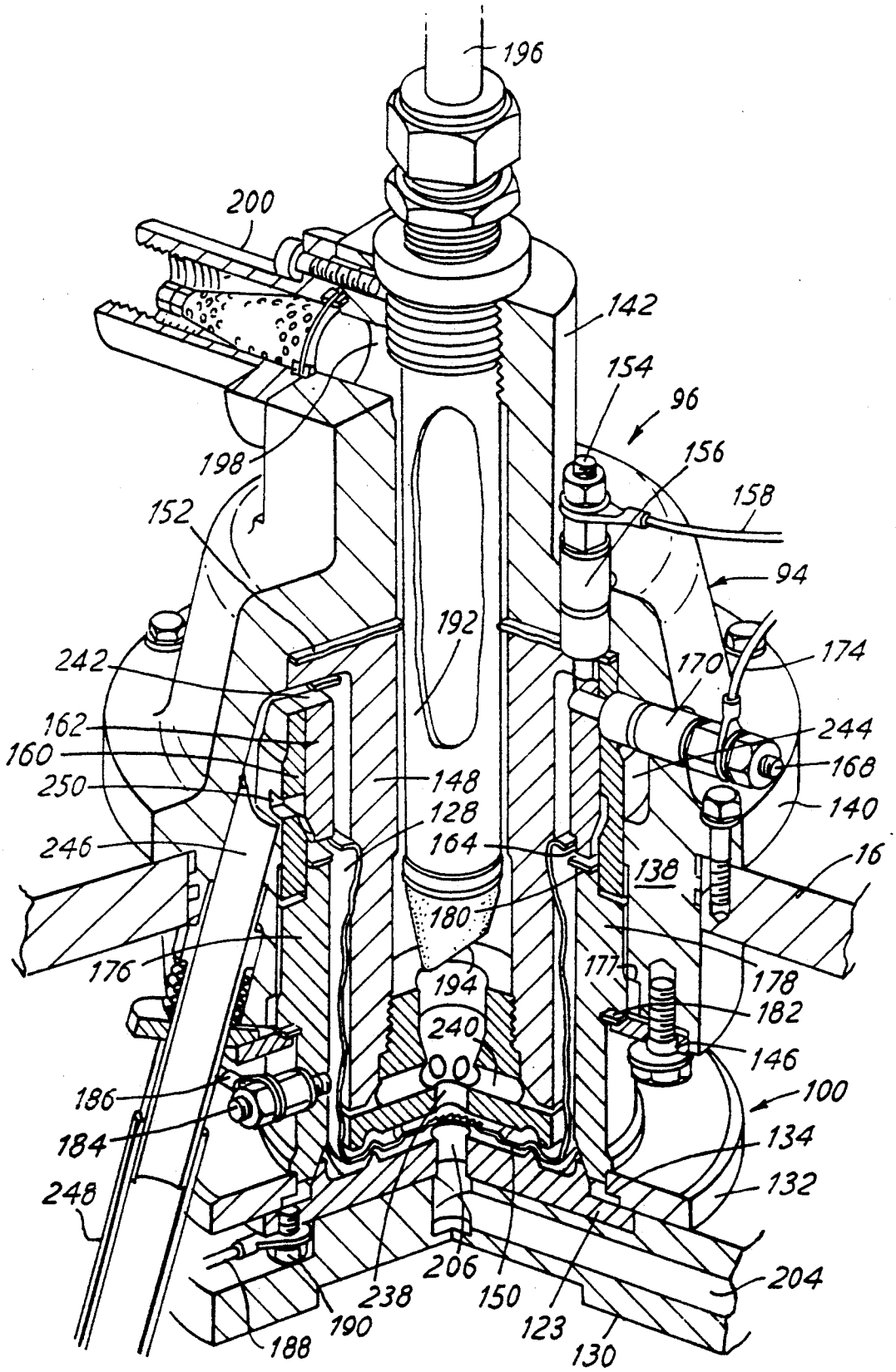
FIG. 4 shows a partly sectioned pictorial view of one said electro-coating cell.

Referring now to the FIGS. 3 and 4, each cell lid 100 includes a circular can-support plate 123* and a plurality of circumferentially spaced, non-conducting pins 124* projecting upwardly from that can-support plate. The upper surface 126* of the can-support plate has a contour which closely complements that of the bottom wall of a can 128* that is to be electro-coated in the cell. The pins 124 are intended to engage and act as minimal base supports for a can 128 to be coated.

The can support plate 123 is carried in a recess formed in a lid support/supply member 130*, and is retained therein by a clamping ring 132*. A resilient sealing ring 134* is secured in an annular groove formed by opposed circular surfaces formed on the can support plate 123 and the encircling clamping ring 132 respectively. The lid support member 130 is secured by bolts to an upper end plate 115 of the associated cell closer 98.

Each cell body portion 94 includes an inverted metal cup portion 138* which is carried in a said aperture 88 formed in the upper annular plate 16 of the drum unit 14, and is secured therein by bolts which pass through an integral flange 140* of the cup portion 138. The cup portion has also an integral upward tubular extension 142*.

An assembly of electrodes 144* is disposed concentrically within the cup portion 138, and is retained therein solely by a retaining ring 146* which is bolted to the lower end of the cup portion. That assembly of electrodes includes a central tubular electrode 148* which is flanged at its upper end, and closed at its lower end by an apertured end cap 150*. The upper end of that electrode is electrically separated from the adjacent parts of the cup portion by a thin annular insulator 152*. A terminal stalk 154* is screwed into the flange of the central electrode, extends upwardly through a tubular insulator 156* mounted and sealed in the upper wall of the cup portion, and has secured thereon the cable eye of a first electrical supply cable 158*.

An apertured tubular insulator 160* lines the upper part of the cup portion 138 and encircles the flange of the central electrode 148. Carried within that tubular insulator and lying adjacent to, but electrically insulated from, the flange of the central electrode is a tubular, can-contacting electrode 162*, which is provided internally at its lower end with a counter-bore 164* for receiving and making electrical connection with the outwardly-turned, upper rim 166* of a can 128 that is to be electro-coated. A second terminal stalk 168* is screwed into the upper end of that tubular electrode, extends radially outwards through a tubular insulator 170* mounted and sealed in the side wall 172* of the cup portion 138, and has secured thereon the cable eye of a second electrical support cable 174*.

A tubular external electrode 176* is supported within the cup portion 138 by means of an external shoulder 178*, which is carried on the retaining ring 146, and by means of an electrically insulating spacer ring 177*. The upper parts of that external electrode adjoin the tubular insulator 160 and the tubular can-contacting electrode 162. Insulating washers 180*, 182* inserted between adjacent parts of the external electrode 176 and the adjoining, can-contacting electrode 162 and the retaining ring 146 respectively provide electrical separation of those parts.

A third terminal stalk 184* is screwed into the lower part of the external electrode 176, extends radially outwards, and receives thereon the cable eye of a third electrical supply cable 186* and the cable eye of an interconnecting cable 188* which is connected at its remote end to the underside of the can support plate 123 by a bolt 190*.

Secured and sealed in the uppermost end of the tubular extension 142 of the cup portion 138 is a fluid support tube 192* which is provided at its lower, end with a normally-closed, non-return rubber valve member 194*, and at its upper end with a supply pipe 196*. That valve member 194 permits the flow of fluid from the supply pipe 196 into the electro-coating cell only when the fluid pressure above it is sufficient to open the valve member; hence, it prevents the loss of electro-coating fluid from the supply tube 192 into the cell when that fluid pressure is cut off from the supply tube.

The tubular extension 142 of the cup portion 138 has near its upper end a transverse port 198* which communicates via a non-return valve unit 200* secured to the tubular extension 142 with a low pressure air supply pipe 202*. That valve unit incorporates a conical rubber valve member which rests on an apertured conical seat, and permits the flow of low pressure air into the cell body 94 via the annular space surrounding the central electrode 148, but prevents the exit of electro-coating fluid from the cell body.

The lid support member 130 is provided with a fluid passage 204* for supplying fluid to a port 206* disposed centrally in the can support plate 123. At its end remote from the port 206* that passage includes a vertical inlet section 208* which terminates at its upper end in a female frustoconical valve seat 210*.

The lid support member 130 also carries an upright valve-actuating push rod 212*. Adjacent lid support members are oppositely handed, to permit the push rods in each pair of adjacent lid support members to lid adjacent one another.

Figure 5A:
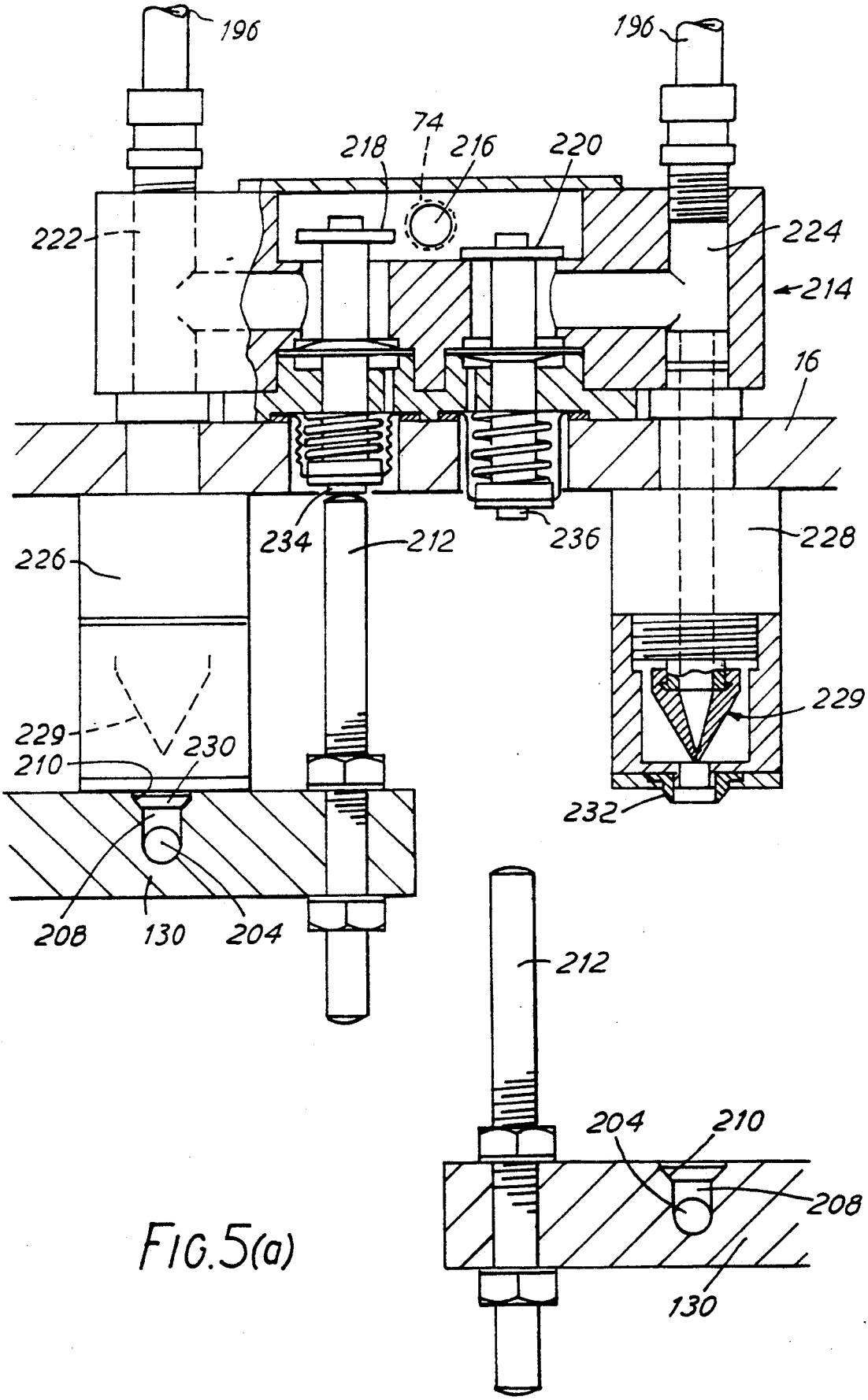
FIG. 5 shows diagrammatically the arrangement of a twin fluid-supply valve for controlling the supply of electro-coating fluid to one such cell, FIG. 5(*a*) being a vertical cross-section through the valve, and FIG. 5(*b*) being a plan view of the valve.
Figure 5B:
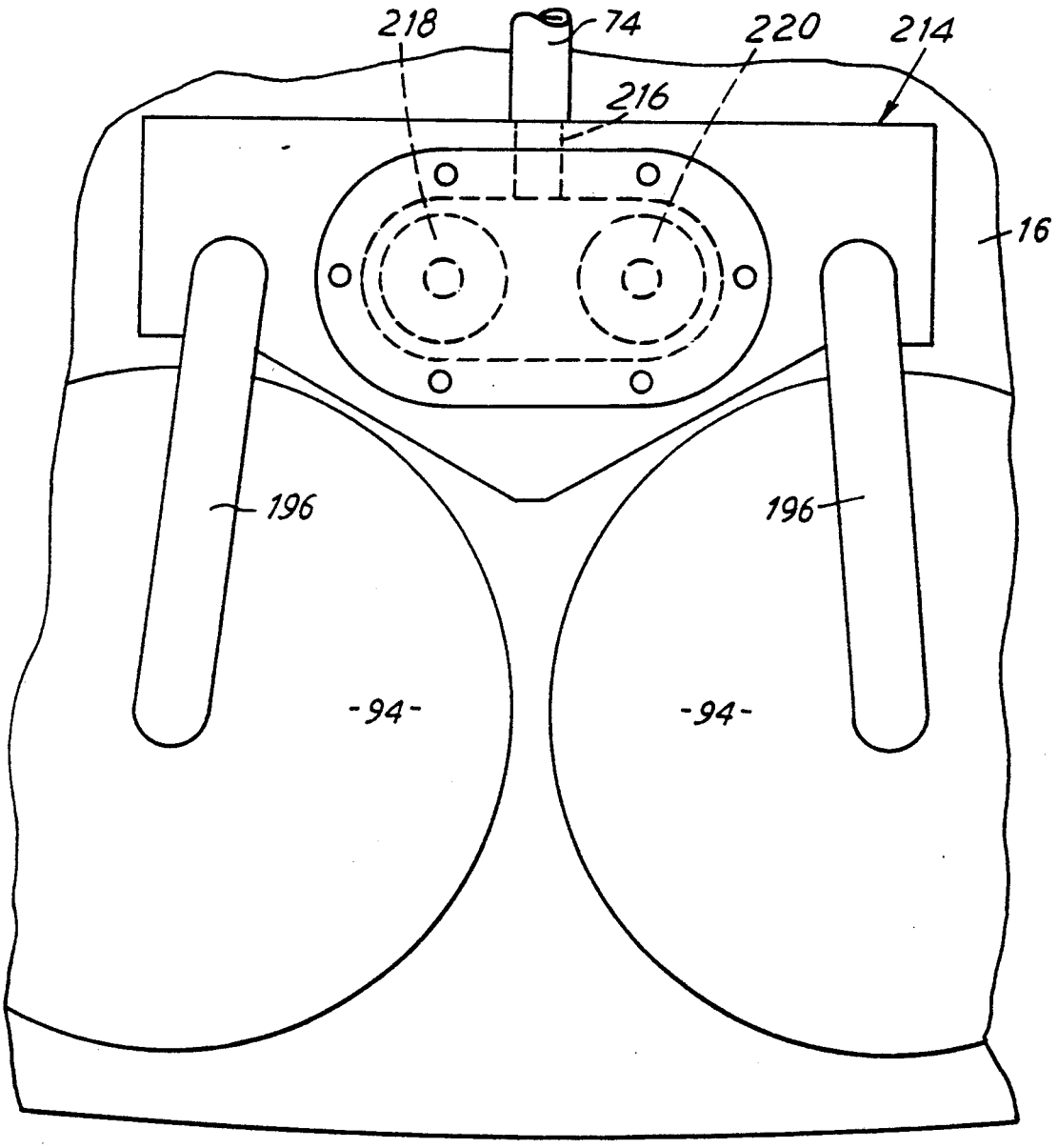

The upper annular plate 16 of the drum unit 14 carries on its upper surface sixteen twin-valve units 214* (see FIGS. 2 and 5) disposed radially inwards of the respective pairs of cell bodies 94. Each such valve unit 214 has an inlet passage 216* connected to one of said fluid feed pipes 74. That inlet passage is connected through respective normally-closed, poppet valves 218*, 220* with respective outlet passages 222*, 224*. Each such outlet passage is connected, on the one hand, upwardly with the said supply pipe 196 of the associated cell body 94, and on the other hand, downwardly with a downwardly-pointing non-return valve unit 226*, 228* situated on the underside of the drum unit upper plate 16. Those non-return valve units incorporate rubber valve members 229* which are similar in construction and operation to the valve members 194 which close the lower ends of the cell supply tubes 192, and have downwardly-pointing, resilient, male outlet nozzles 230*, 232*, each of which is arranged to engage, when the associated lid is raised to close the cell, in the said female valve seat 210 of the associated lid support member 130, and so complete a flow passage to the central port 206 in the can support plate 123.

The push rods 212 carried by the two lid support members 130 of the associated cell closers are aligned vertically with the respective tappets 234*, 236* which depend from the valve unit 214, project through the drum unit upper plate 16, and are operable by respective push rods 212 whereby to effect operation of the respective poppet valves.

Thus, when a cell closer 98 operates to raise the associated lid support member 130 and so close the associated cell 96, closure of the cell occurs simultaneously with the closure of the associated valve output nozzle (e.g. 250) on to its associated valve seat 210 and with the raising of the associated poppet valve (e.g. 218) to cause the flow of fluid from the feed pipe 74 to the associated cell body 94 via the upper feed pipe 196 whereby to flood the interior of a can 128 present in and to be coated in the cell, and simultaneously to the central inlet port 206 formed in the can support plate 123 whereby to rapidly immerse the exterior of that can 128.

Coating fluid admitted to the cell body via the fluid supply pipe 196, tube 192 and the non-return valve member 194 passes into contact with the interior the can 128 to be coated via a series of longitudinal passages 238* formed in the end cap 150, and if necessary, via a series of radial passages 240* formed in or adjacent the end cap 150; and after filling the can rises to the level of, and escapes from the cell body via, radial apertures 242* formed in the upper parts of the can-contacting electrode 162 and encircling tubular insulator 160. The fluid passes thence via an annular gallery 244* formed in the cup portion 138 and two circumferentially-spaced, oblique outlet passages 246* to two flexible exhaust pipes 248*. These pipes pass through the internal walls 20 and 24 of the drum unit 14 to discharge their flows on to the upper funnel member 50, from where it flows via the collector pan 54 and exit holes 60 to the reservoir 62.

Coating fluid admitted to the closed cell via the central inlet aperture 206 in the can support plate 123 rises around the can 128 to the level of the upper rim 166 of the can from where it exits via radial and longitudinal passages 250* formed in and between the can-contacting electrode 162 and the encircling tubular insulator 160, to the gallery 244.

Figures 6A, 6B, 6C:
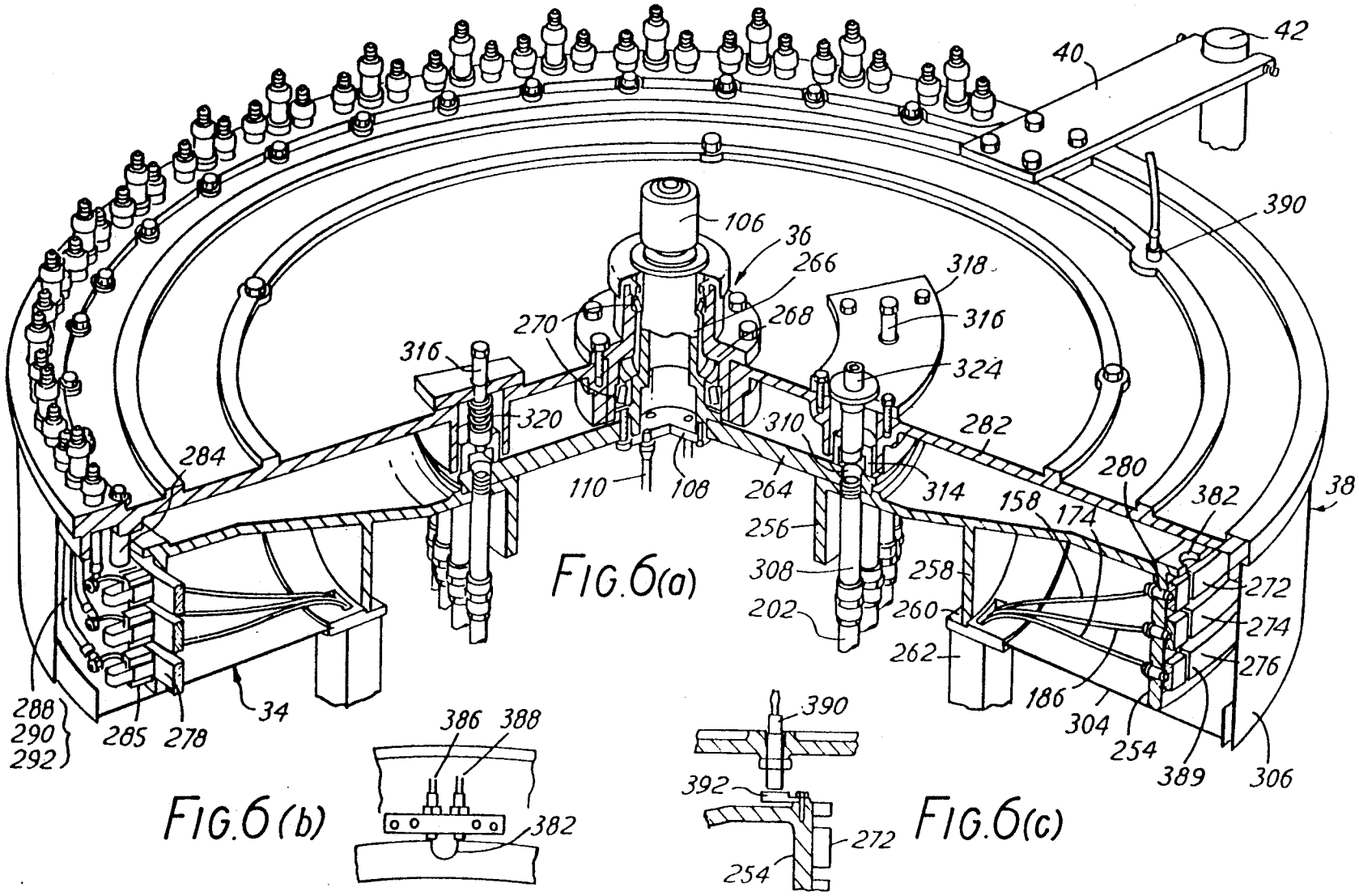
FIG. 6 shows the construction of a slip-ring and brushgear assembly which constitutes the upper part of the apparatus shown in the FIG. 1, FIG. 6(*a*) showing a partly sectional pictorial view of the assembly, FIG. 6(*b*) showing a scrap plan view of a pair of turntable rotation detecting sensors incorporated in that assembly, and FIG. 6(*c*) showing a scrap vertical section revealing a turntable datum-position detecting sensor incorporated in that assembly.
Figure 7A:
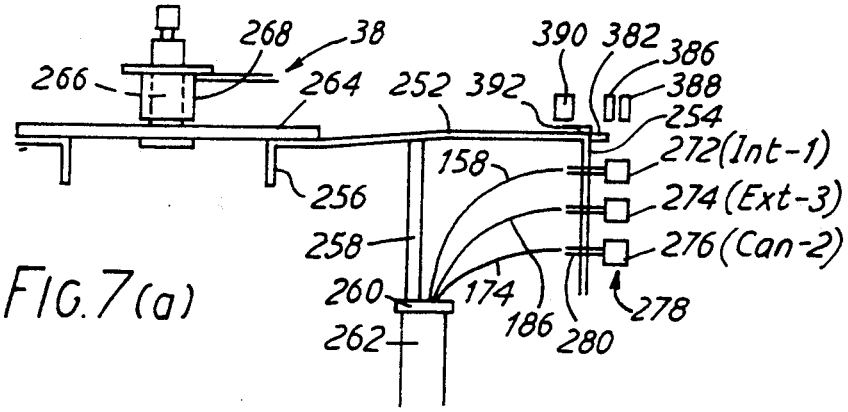
FIG. 7 shows diagrammatically, in vertical sectional views, the construction of the slip-ring and brushgear assembly of FIG. 6, FIG. 7(*a*) showing a slip-ring carrying part of that assembly, and FIG. 7(*b*) showing that slip-ring carrying part in association with a brushgear carrying part of that assembly.
Figure 7B:
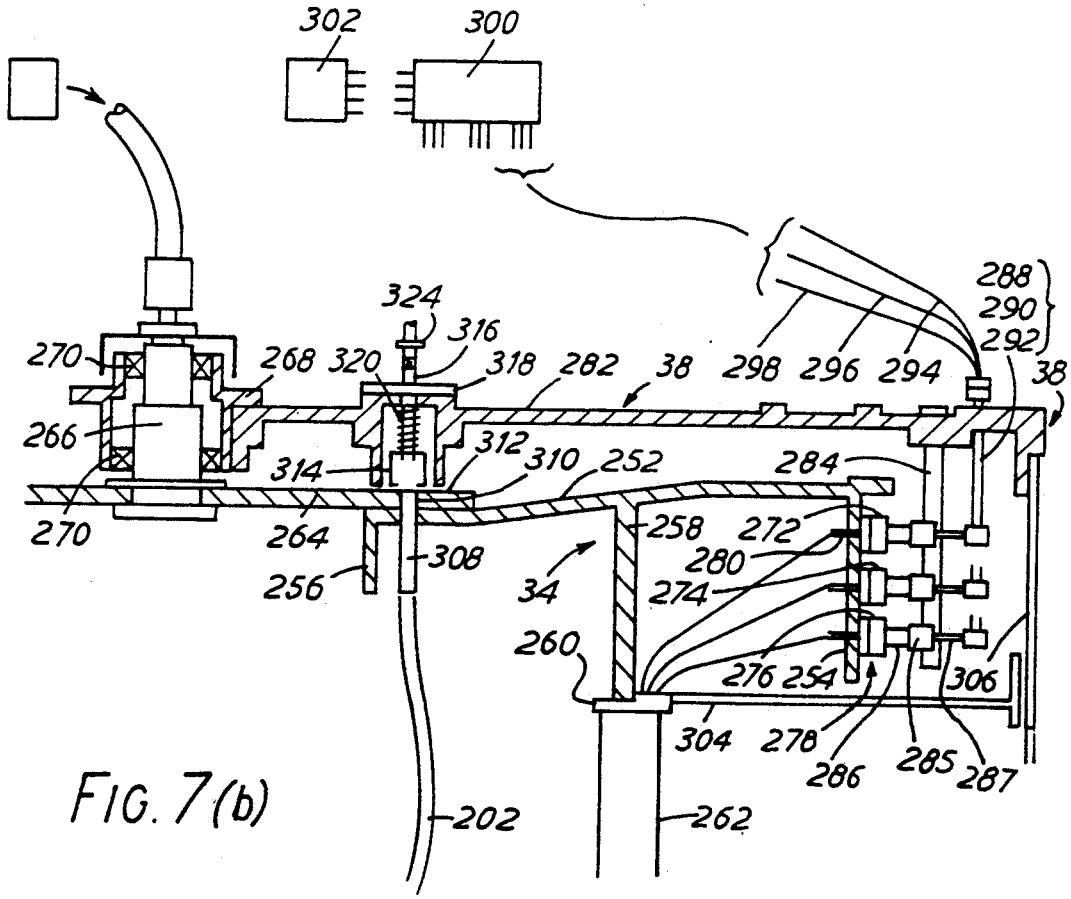

Referring now to the FIGS. 6 and 7, the slip-ring unit 34 comprises essentially an outer annular plate 252* having dependent therefrom radially-spaced outer, inner and intermediate cylindrical walls 254*, 256*, 258*. The intermediate wall 258 is secured on an annulus 260*, which is itself secured on four equi-spaced, hollow, vertical columns 262* which are carried by an annulus 263* secured on the inner peripheral part 30 of the drum unit upper plate 16.

The annular plate 252 carries a central bearing support disc 264* from the centre of which a hollow bearing shaft 266* rises. A bearing sleeve 268* is carried on that bearing shaft 266 by two vertically-spaced bearing races 270*, and carries itself the brush gear unit 38. The bearing shaft 266 and associated bearing sleeve 268 constitute the said central bearing unit 36.

The outer cylindrical wall 254 carries externally thereon three vertically-spaced circles 272*, 274*, 276* of slip-ring segments 278*, which segments are identical with one another and are electrically insulated from one another and from the cylindrical wall carrying them. Permanent electrical connections with those slip-ring segments are made internally of the wall 254 by means of electrically insulated connection stalks 280* which pass through that wall and secure the segments in position thereon. Each circle of segments comprises thirty-two segments, i.e., one for each of the cells 96.

The slip-ring segments of the upper circle 272 receive on their respective connection stalks 280 the remote ends of the respective said first electrical supply cables 158 which are connected to the interior electrodes 148 of the respective cells.

The slip-ring segments of the middle circle 274 receive on their respective connection stalks 280 the remote ends of the respective said third electrical supply cables 186 which are connected to the external electrodes 176 and 123 of the respective cells.

The slip-ring segments of the lower circle 276 receive on their respective connection stalks 280 the remote ends of the respective said second electrical supply cables 174 which are connected to the can-contacting electrodes 162 of the respective cells.

Slip-ring segments which are in vertical alignment in the three circles are associated with the various electrodes of the same cell 96. The said electrical supply cables are carried downwards to the respective cells through the respective hollow vertical columns 262.

The brush gear unit 38 comprises a circular brush carrier plate 282* which is carried centrally by the bearing sleeve 268, and which has dependent therefrom, around a predetermined portion thereof, seventeen circumferentially-spaced brush support posts 284*. Each said post is provided with an electrically-insulating support member, and carries thereon, one above the other, three brush boxes 285* in which carbon brushes 286* are urged by biassing spring means (not shown) into contact with vertically-aligned slip-ring segments. The angular pitch of the brush support posts 284 is equal to that of the electro-coating cells 96, and hence to that of the slip-ring segments.

Each brush support post 284 has associated therewith three electrical terminal stalks 288*, 290*, 292* which are secured in and extend through the brush carrier plate 282 to positions adjacent the respective brush boxes 285, at which positions the flexible connections 287* of the respective brushes 286 are connected to those respective terminal stalks.

Groups of three electric supply cables 294*, 296*, 298* are connected to the respective groups of terminal stalks 288, 290, 292, and are carried away to appropriate electric supply terminals of a d.c. supply source 300* which is connected to and controlled by a control and monitoring apparatus 302*. That supply source is fed from an a.c. supply system (not shown), and incorporates a full-wave, thyristor bridge rectifier circuit to deliver the requisite d.c. voltage.

The slip-ring unit 34 includes a lower, horizontal cover plate 304* which extends radially outwards from the annulus 260 to meet in spaced relationship an outer, vertical cover plate 306* which is carried peripherally by the brush carrier plate 282.

The low pressure air supply pipes 202 of the respective cells 96 have their upper ends connected to pipes 308* which are dependent from the slip-ring carrier 252, 264 and which open at their respective upper ends into ports 310* formed around the upper peripheral plane surface 312* of the bearing plate 264.

A kidney-shaped manifold 314* lies on that plane annular surface 312, covers a predetermined number of the ports 310 in that surface, and is restrained against circumferential movement by upright posts 316* which are secured to the top of the manifold 314 and which slidably extend through a cover plate 318* which covers a kidney-shaped access opening formed in the brush carrier plate 282. The manifold is urged into close sliding contact with that plane annular surface 312 by compression springs 320* carried on the location posts 316 and trapped under the cover plate.

A low pressure, high flow rate air supply source (not shown) is connectable with the manifold 314 by means of a connector 324* which is secured in the cover plate 318 and which extends in fluid-tight sliding relation through the top of the manifold 314.

Mounted at the front of the apparatus so far described are infeed and outfeed devices 326*, 328* which are driven by the rotatable drum unit 14 by means of gear wheels 330*, 332* which mesh with the toothed gear ring 44 of that unit.

THE INFEED DEVICE

Figure 8A:
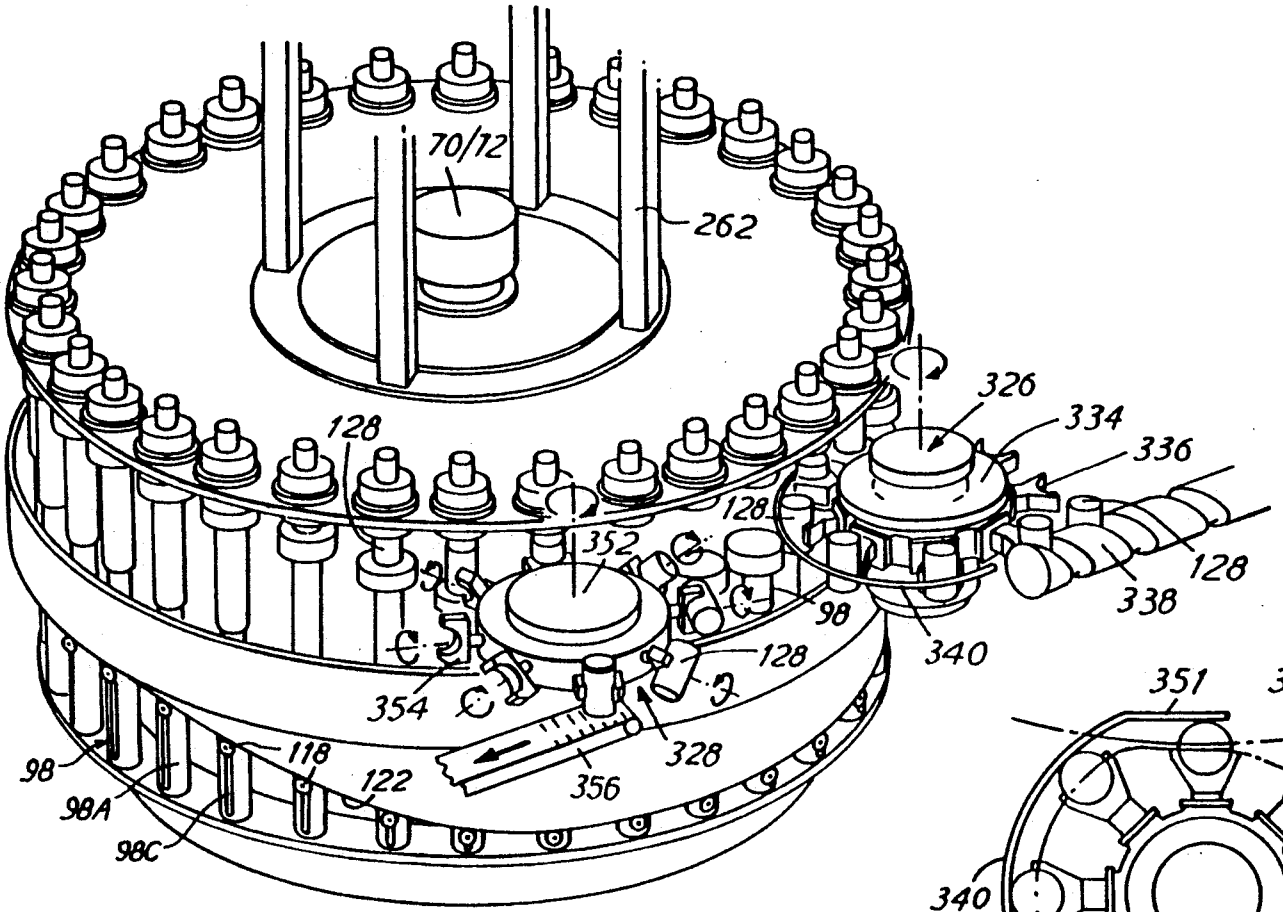
FIG. 8 shows pictorially the dispositions and external details of infeed and outfeed devices which form part of the electro-coating apparatus, FIG. 8(*a*) showing an enlargement of the lower part of the FIG. 1, and FIG. 8(*b*) showing a plan view of the infeed device.
Figure 8B:
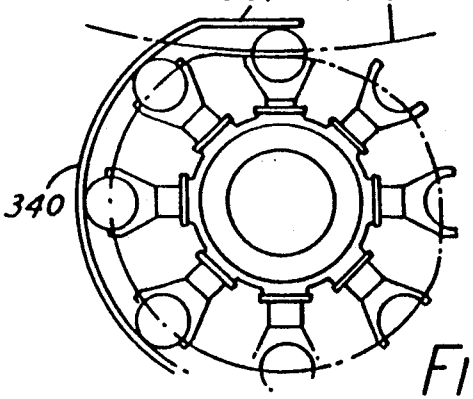
Figures 9A, 9B:
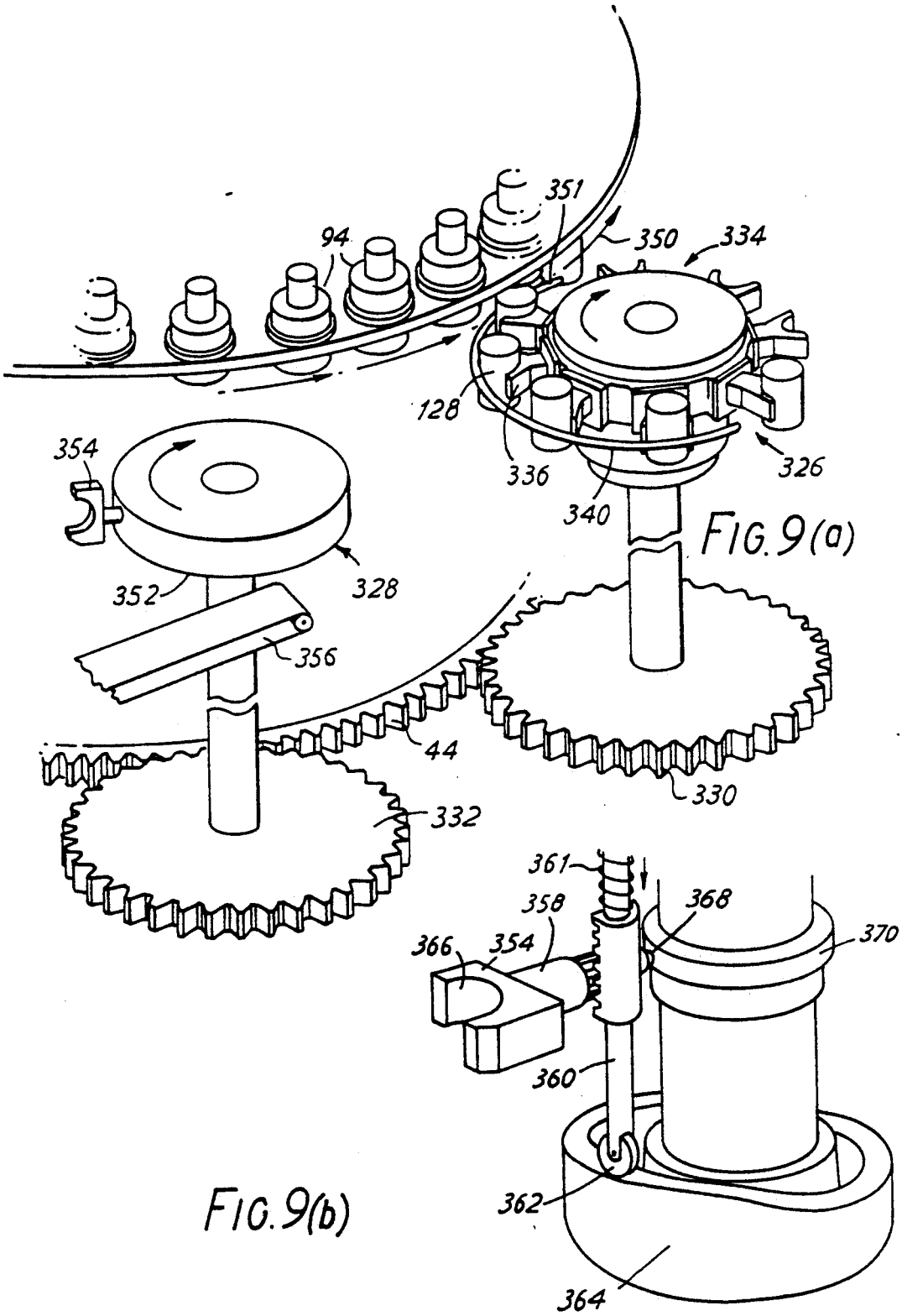
FIG. 9 shows in a further diagrammatic form the subject matter shown in the FIG. 8, FIG. 9(*a*) showing pictorially the infeed and outfeed devices, and FIG. 9(*b*) showing pictorially a mechanism incorporated in the outfeed device.
Figure 10:
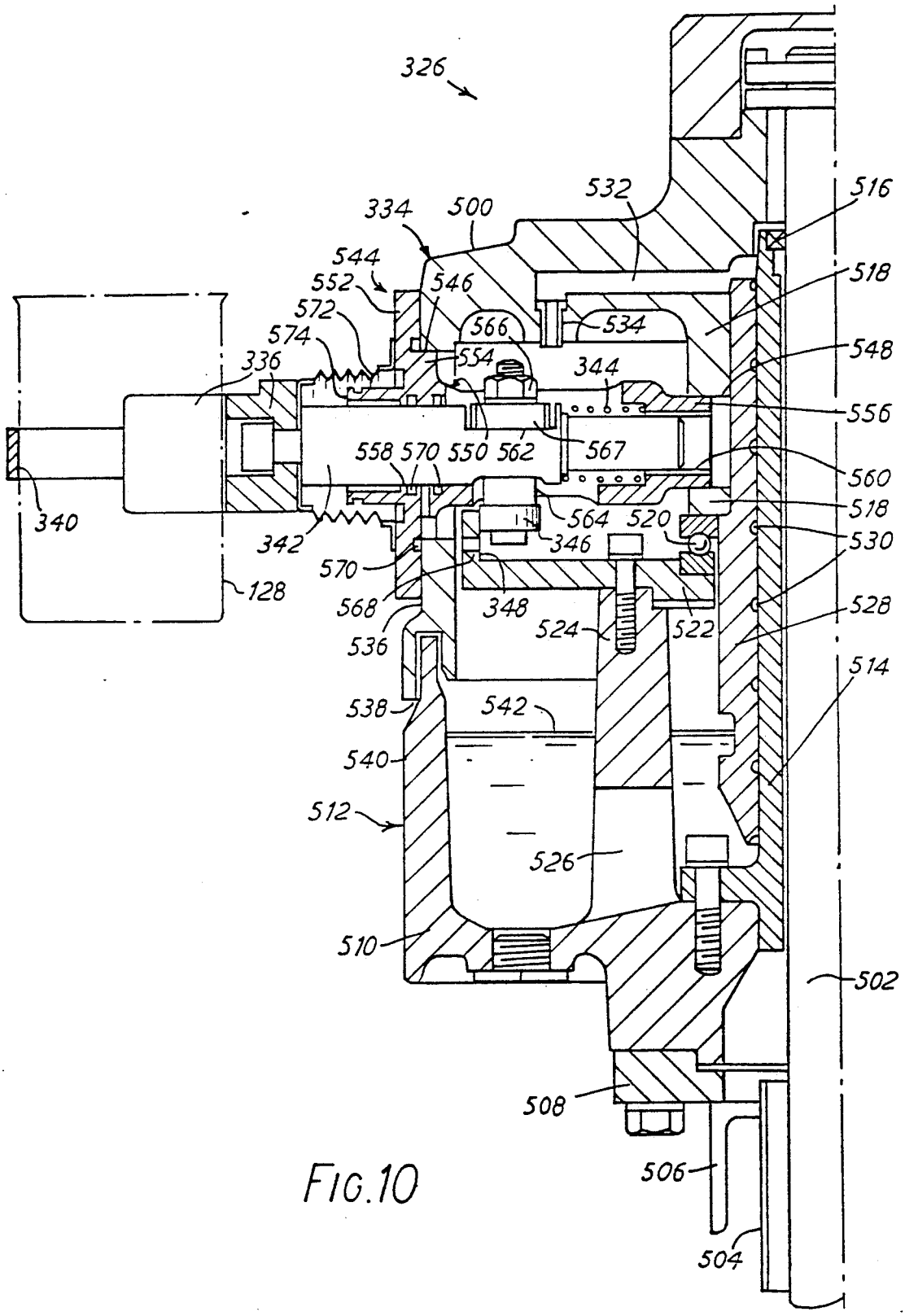
FIG. 10 shows in a vertical cross-section the construction and mode of operation of the infeed device shown in the FIG. 8, which cross-section is taken on a diametral plane of the infeed device.

Referring now to the FIGS. 8 to 10, the infeed device 326 includes a rotatable turret 334* carrying a series of eight can holders or pockets 336* which are spaced apart around the turret and which are arranged to transfer, on rotation of the drum unit, respective cans 128 supplied to it by a synchronised screw feed-conveyor 338* to respective cell closers 98 as they pass through a predetermined first or infeed station adjacent the infeed device. A guide rail 340* extending part way round the turret causes the cans to follow, as they are urged along by one of said can holders, a predetermined arcuate path from the conveyor 338 to the cell closer then at the infeed station.

As shown in the FIG. 10, each can holder 336 is carried within the turret 334 on a retractable shaft 342* which is biassed by an helical compression spring 344* to an outer can-guiding position. That shaft has, within the turret, a cam follower wheel 346* which is urged by the action of that biassing spring radially outwards against the shaped internal surface of a static, generally circular cam 348*. That cam surface is shaped so as when the can holder moves into the position for depositing a can on the cell lid then at the infeed station, it is gradually and temporarily retracted slightly so as to enable the can holder to follow for a short way the locus 350* of the cell lid 100 as it moves into, through and beyond the infeed station. This enables the can to be properly transferred to and positioned on the cell lid, since the can holder and cell lid move for a short way along the same locus. The guide rail 340 is also shaped as shown at 351* so as to cause the can to move into and along that locus 350.

In more detail, the infeed turret 334 comprises an inverted cup-shaped member 500* secured at the top of a driving shaft 502* which rises, through a tubular shroud 504*, from a torque-limiting device (not shown) which is connected to the gear wheel 330. That shroud passes upwardly through a transverse support channel 506* which carries on its surface a fixed, turret-location socket 508*. Secured in that socket is a turret support means 510* which incorporates a lubricating oil reservoir tank 512*. An upstanding tubular member 514* constituting an inner wall of that oil tank encloses the driving shaft 502 which extends therethrough with clearance. A seal 516* provided at the upper end of that tubular member 514 prevents the exit of lubricating oil between that member and the driving shaft.

The turret incorporates a dependent, inner cylindrical wall 518* of which the lower end is rotatably supported on a ball bearing race 520* which is itself carried on a transverse platform 522*. That platform is secured by screws on an upstanding intermediate cylindrical wall 524* which rises out of the oil tank and which has in its lower part an aperture 526* to allow circulation of the lubricating oil within the tank.

An oil pumping sleeve 528* encircles the upstanding tubular member 514, is secured at its upper end in the inner dependent wall 518 of the turret, and has formed in its bore a spiral, oil-pumping groove 530*. Thus, on rotation of the turret oil from the reservoir rises up the spiral groove and is delivered at the upper end of the sleeve 528 into a plurality of radial, distribution ducts 532* from where it escapes via vertical nozzles 534* into the spaces enclosed below.

The lower rim of the outer cylindrical wall 536* of the turret has an annular groove 538* into which extends the thin upper rim of the outer cylindrical wall 540* of the oil reservoir tank 512, in such manner as to prevent the ingress of electro-coating fluid into the reservoir tank. The lubricating oil surface level indicated at 542* is maintained at a height such as to prevent the loss of oil between the tongue-and-groove junction of the outer walls of the turret and oil tank.

The turret has secured around its circumference at each of eight equi-spaced positions a respective can holder unit 544*, which is removably carried within radially-aligned, large and small apertures 546*, 548* formed respectively in the outer and inner cylindrical walls 536 and 518 of the turret.

Each can holder unit comprises a slotted body 550* which is provided at one end with a fixing flange 552* and an adjacent spigot portion 554* for locating and securing (by screws not shown) the unit in position in the aperture 546, and at the other end with a plug portion 556* which locates in said smaller aperture 548.

The retractable shaft 342 supports at its outer end the associated can holder 336, is slidably carried in respective radially-aligned bores 558*, 560* formed in the respective end portions of the slotted body 550, and has a central waisted portion 562* in which is carried a vertical stub shaft 564*. That stub shaft is secured in position by a nut 566* which engages the slotted body via a slide block 567* carried in a slide way formed in the slotted body, and carries rotatably mounted at its lower end the said cam follower wheel 346. The biassing spring 344 is trapped on the retractable shaft 342 between shoulders formed on that shaft and in the slotted body.

The transverse platform 522 has at its outer periphery an upstanding wall 568*, of which the inwardly facing surface constitutes the said circular cam 348.

Sealing rings 570* are provided on the retractable shaft, and behind the fixing flange 552, to prevent the ingress of electro-coating fluid into the turret, and also to prevent the egress of lubrication oil. Annular shrouds in the form of flexible bellows 572* are provided on the retractable shaft 342 and the fixing flange 552, and a tubular extension 574* is provided on that flange, all for that same purpose.

THE OUTFEED DEVICE

Figure 11:
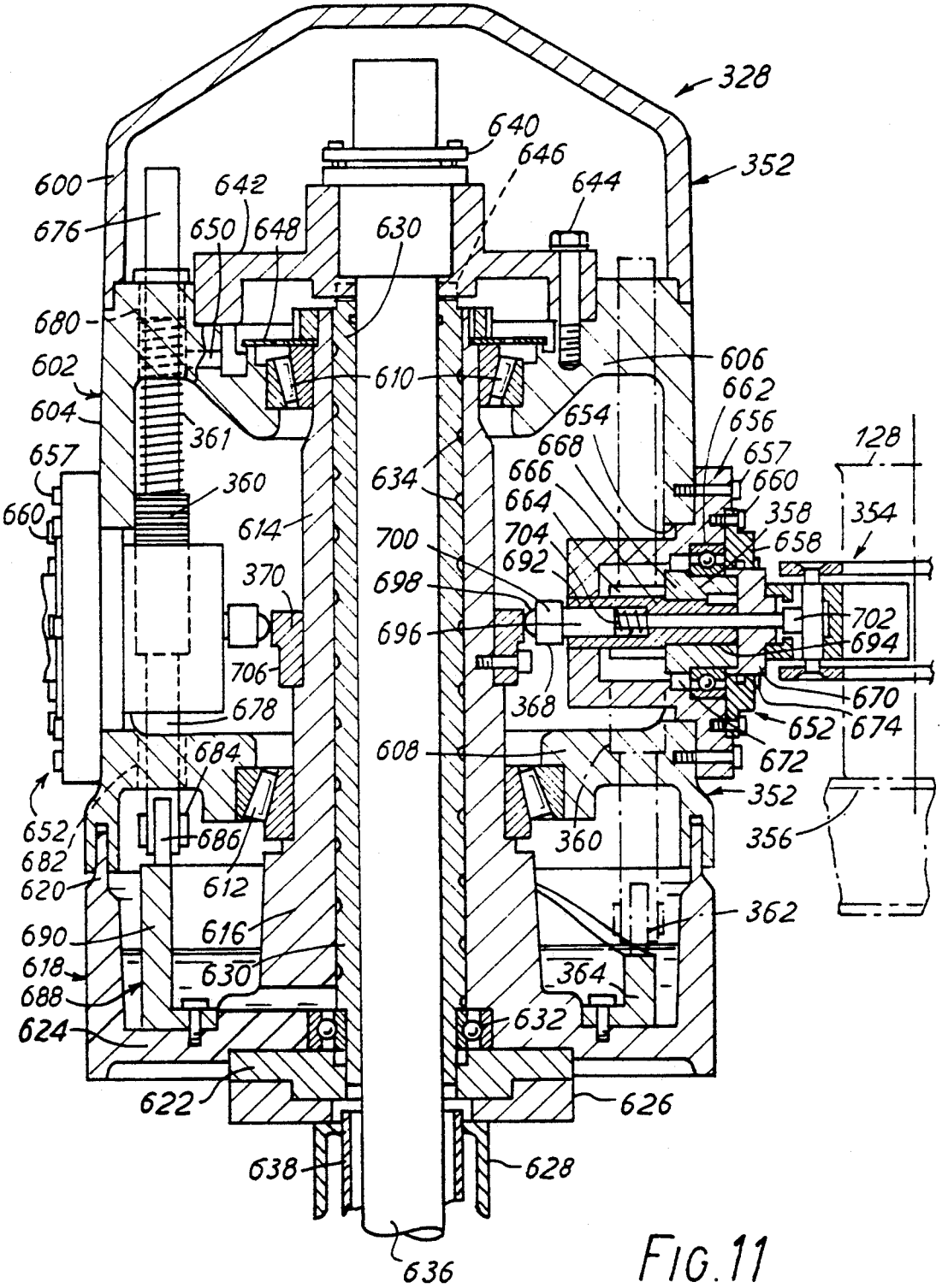
FIG. 11 shows in a vertical cross-section the construction and mode of operation of the outfeed device shown in the FIG. 8, which cross-section is taken on a diametral plane of the outfeed device.
Figure 12D:
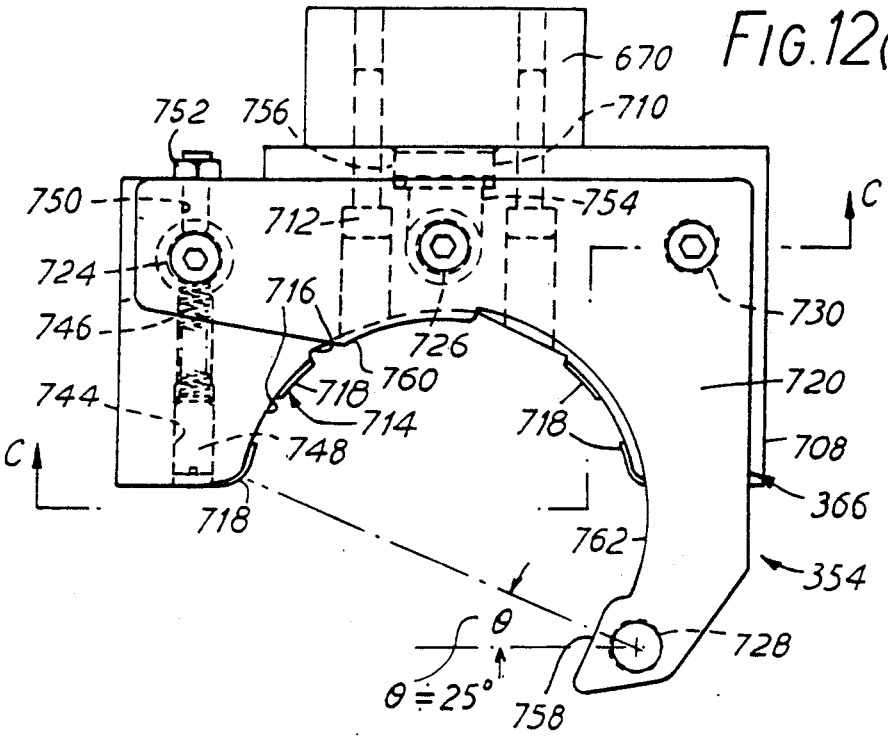
FIG. 12 shows the construction of one of several can gripper assemblies incorporated in the outfeed device, the respective FIGS. (*a*) to (*d*) showing respective views which are self-evident from those FIGS.
Figure 12C:
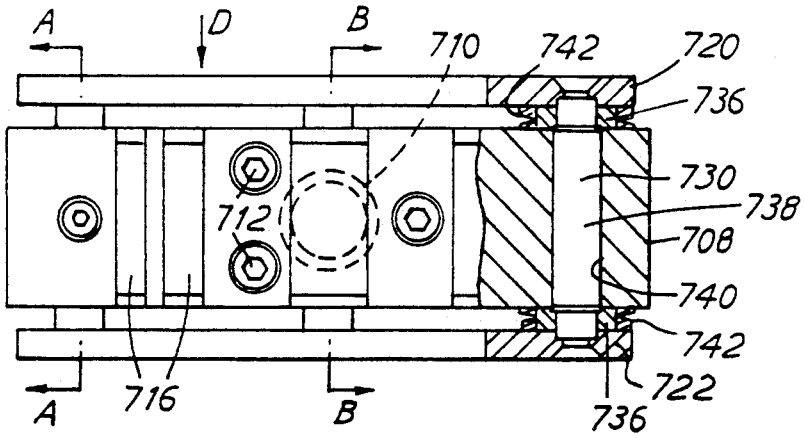
Figure 12A:
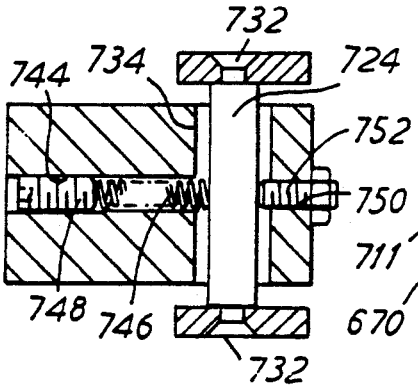
Figure 12B:
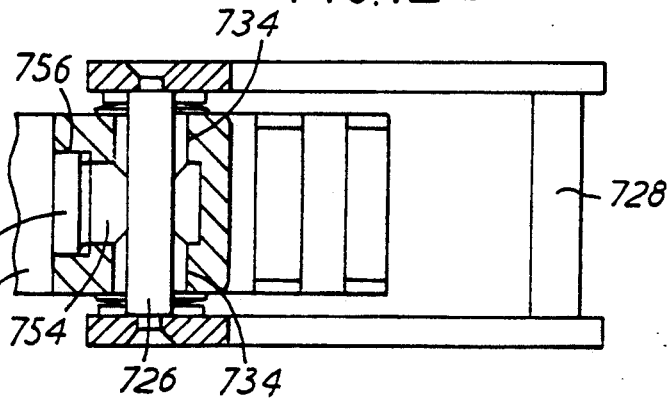

Referring now to the FIGS. 9 and 11, the outfeed device 328 likewise includes a rotatable turret 352*, which turret carries a series of eight can-grippers 354* spaced apart around it and arranged to receive in turn successive cans that are brought by rotation of the drum unit 14 to a predetermined outfeed station adjacent the outfeed device. Each of the can-grippers is arranged so as in turn, to lightly grip and remove from the cell lid 100 passing through the outfeed station a can presented to it at that station, then as the turret moves on, to rotate the can clockwise (as seen from the turret) about its transverse axis through an angle of 180° so as to empty the coating fluid still remaining in the can into a trough below (not shown) and thereafter release and deposit the can, open end downwards, on to an outfeed conveyor 356*, and finally on continued rotation of the turret, to reverse the gripper to its former position ready to receive the next can presented to it at the outfeed station.

Each can gripper 354 is carried within the turret 352 on a rotatable shaft 358* having gear teeth which engage with those of a vertically-reciprocable gear rack 360*. That rack is spring biassed by a compression spring 361* to its lowermost position, and has associated with it, within the turret, a cam follower wheel 362* which cooperates with a static annular cam 364* of cyclically varying height. When the gripper is at the outfeed station ready to pick up a can, the height of the cam beneath the follower wheel is at a maximum value.

During rotation of the turret through a first half revolution from the outfeed station, the cam allows the rack to move temporarily to a lower position and then, during the second half revolution, causes the rack to return to its biassed upper position. Such movement of the rack thus rotates the associated gripper shaft 358 through 180° (thereby rotating a gripped can so as to empty its contents in the direction of rotation of the turret), and then returns it to its former position, all within the course of one complete revolution of the turret, so as to achieve the desired can gripper operation.

Each can gripper 354 includes a movable jaw member 366* which is biassed to a closed can-gripping position, and which is operated within the turret by a cam follower 368* which is biassed radially inwards into contact with a static cam 370* of cyclically varying radius. That cam and follower arrangement is arranged so as (a) to present the gripper in its open, can-receiving condition to the can then moving into the outfeed station, (b) then as the turret rotates to move the gripper through that station, to allow the movable jaw member to close lightly and temporarily on to the can so as to grip it during the following period whilst it is being rotated to the mouth-down position, and finally (c) to return the jaw member to its open position as the gripper approaches the outfeed conveyor, so as to release the gripped can on to that conveyor. The gripper jaw member remains open until after the gripper has been carried around into engagement with the next can to be gripped and conveyed by that gripper.

In more detail, the outfeed turret 352 includes, beneath a protective cap 600*, a drum 602* which comprises a generally cylindrical outer wall 604* supported by two vertically spaced, integral, transverse walls 606*, 608*. The drum is rotatably carried by complementary taper bearing races 610*, 612* which engage externally with said transverse walls 606, 608, and internally with an upstanding tubular bearing member 614*. That bearing member extends upwardly from the inner wall 616* of an integral annular oil reservoir tank 618*, which tank has an upstanding outer cylindrical wall 620*. That wall has its upper rim extending upwardly into a groove formed in the lower rim of the cylindrical drum wall, in a manner such as to exclude electro-coating fluid from the turret.

An annular turret location plate 622* screwed to the base wall 624* of the reservoir tank 618 has a lower, spigot portion which engages in a turret locating socket 626* which is itself secured on a transverse channel 628*.

An oil pumping sleeve 630* lines the tubular bearing member 614, is supported at its base by a ball bearing race 632* which is trapped in a recess in the oil tank base wall 624 by the turret location plate 622, and is provided in its external cylindrical surface with a spiral oil pumping groove 634*.

A turret driving shaft 636* rises from a torque-limiting device (not shown) which is connected to the gear wheel 332, through a tubular shroud 638*, the support channel 628, the location socket 626, and the oil pumping sleeve 630, and is secured by adjustable coupling means 640* to a transverse circular driving plate 642* which is secured to the upper drum wall 606 by screws 644*. Axially extending teeth 646* formed at the upper end of the oil pumping sleeve 630 engage in driving slots formed internally in the driving plate 642.

Lubricating oil pumped to the top of the pumping sleeve 630 flows downwardly (a) over a baffle plate 648* in which are provided vertical oil holes for directing oil into the upper bearing race 610, and (b) outwardly through transverse radial passages 650* to lubricate the other moving parts that are enclosed within the turret.

The turret has secured around its circumference at each of eight equi-spaced positions a respective can gripper unit 652*, which is removably carried in an aperture 654* formed in the cylindrical wall 604. Each can gripper unit 652 comprises a flanged body 656* secured in said aperture 654, by screws 657*, and having an annular closure member 658* secured thereto, by screws 660*. That closure member secures in position a ball bearing race 662* in which said rotatable shaft 358 is journalled for rotation. That shaft comprises an assembly consisting of (a) a pinion 664* and an integral shaft 666* which is received in said ball bearing race 662, and (c) a gripper support member 670* which protrudes through said closure member 658, all such parts being secured for rotation together.

Sealing rings 672* are provided on either side of the ball bearing race so as to exclude therefrom lubricating oil from within the turret and electro-coating fluid from outside the turret. The closure member 658 and gripper support bush 668 also carry baffles 674* for minimising the penetration of such fluid.

The flanged body 656 has adjacent the pinion 664 an opening through which the associated vertically reciprocable gear rack 360 extends and meshes with said pinion. That rack has upper and lower support shafts 676*, 678* which are slidably carried via bearing bushes 680*, 682* in the upper and lower transverse walls 606, 608 of the turret drum. The upper support shaft 676 carries around it the said compression spring 361, whilst the lower support shaft carries at its lower end, on a transverse pin 684*, a ball bearing race 686*, of which the outer race member constitutes the said cam follower wheel 362.

An annular cam unit 688* is secured on the base wall 624 of the oil tank 618, and has an upstanding cylindrical wall 690* of varying height, which wall is positioned beneath and supports the said cam follower wheel 362, and so constitutes the said annular cam 364.

The gear rack and associated parts are lubricated by oil dropping from the radial passageways 650.

The rotatable shaft assembly 358 has a central bore in which axially spaced bearing surfaces 692*, 694* formed in the pinion shaft 666 carry a slidable gripper operating shaft 696*. That gripper operating shaft carries (a) at its inner end, said cam follower 368 which is constituted by a ball bearing 698* rotatably held in a bearing socket 700*, (b) at its outer end, a gripper operating button 702* which protrudes beyond the extremity of the gripper support member 670, and (c) intermediate its ends, a compression spring 704* trapped between opposed shoulders formed on the shaft 696 and in the bore of the pinion shaft 666, for biassing the gripper operating shaft radially inwards of the turret.

The cam follower ball 698 rests in contact with the outer surface of a cam ring 706* which encircles and is secured by screws to the central tubular bearing member 614. That cam ring has varying radial depth, and constitutes the said static cam 370 for operating the associated gripper, via said gripper operating shaft 696.

The construction of one said can gripper 354 is best seen in the FIG. 12, where it is shown detached from the turret. The can gripper comprises a gripper block 708* having formed in its rear face a cylindrical mounting socket 710* arranged for engagement on a plug portion 711* formed on said gripper support member 670. The gripper block is arranged to be secured on that support member 670 by three screws 712* which are sunk in respective counter-bored holes formed in the gripper block.

The front face of the gripper block is symmetrically shaped at 714* to suit the cylindrical shape of a said can 128 that is to be transported and emptied by the gripper, and that face is relieved at spaced vertically-extending regions 716*, to leave four circumferentially-spaced can-containing surfaces 718*.

The gripper block is sandwiched between two jaw plates 720*, 722*, which are spaced apart and from the gripper block by four spacer pins 724*–730*. Countersunk fixing screws 732* received in the respective ends of those spacer pins pass through and so clamp the jaw plates to the spacer pins so as to form a said gripper jaw member 366. The three pins 724 to 728 are similar and constitute simple, butted spacer pins for securing together the gripper plates at the desired spacing. The pins 724, 726, and 730 pass with substantial clearance through holes 734* formed in the gripper block. The pin 730 has (a) end portions of reduced diameter which engage in recesses formed in the jaw plates and carry spacer rings 736*, and (b) a central bearing portion 738* which is journalled in a bearing hole 740* formed in the gripper block. Hence, the jaw member 366 is pivotally mounted on the gripper block by means of the spacer pin 730. Sealing ring 742* encircle the spacer rings 736 and serve to exclude electro-coating fluid from the cooperating bearing surfaces of the gripper block and jaw member.

The gripper block is provided with a first screwed bore 744* which intersects with the clearance hole 734 that houses the spacer pin 724. A bias compression spring 746* is trapped in that bore and is urged into contact with that spacer pin 724 by a grub screw 748*. The gripper block is also provided with a second screwed bore 750* aligned with said first screwed bore 744 and in which is screwed an adjustment stud 752* for setting a biased, "closed" position of the jaw member 366 relative to the gripper block 708.

The gripper block is also provided with a bore 754*, and a counter-bore 756*, having an axis which intersects with that of the clearance hole 734 housing the spacer pin 726. That counter-bore constitutes the aforesaid socket 710 for receiving the plug portion 711 of the rotatable gripper support member 670.

When a gripper assembly 354 is mounted and secured on a gripper support member 670, the gripper operating button 702 rests adjacent but not touching the jaw operating spacer pin 726, so that the jaw member is biased to the closed position dictated by the setting of the adjustment stud 752. On rotation of the gripper turret, the static cam ring 706 cyclically and temporarily presses the cam follower 698, 700 and gripper operating shaft 696 radially outwards against the thrust of the biassing spring 698, thus causing the jaw operating button 702 to press against and temporarily displace the spacer pin 726 and so temporarily open the gripper jaw member relative to the gripper block.

The jaw plates 720, 722 are shaped in the manner shown, and have each a can-gripping land 758* spaced from a can-ejecting land 760* by a relieved region 762*. Those can-contacting lands are positioned in relation to the can-contacting lands 718 of the gripper block such that when the jaw member is in the closed position gripping a can, that can is contacted by those lands over a circumferential length which exceeds by a small amount half the circumference of the can.

The entrance to the space enclosed by the gripper block 708 and jaw member 366 is inclined relative to the axis of rotation of the gripper at an angle of approximately 25°, which angle is dependent on the relative diameters of the two circular paths followed by a can when travelling respectively (a) on a cell lid 100, and (b) in the grip of a gripper, and is determined to suit the path relative to a gripper of a can entering the gripper at the outfeed station.

For a can of a given diameter, that entrance to the space enclosed by the gripper, when the jaw member 366 is in the open position, has a dimension approximately 1 mm greater than the can diameter. A movement of approximately 1 mm of the can-contacting land 758 of the jaw member 366 between the open and closed positions suffices to enable satisfactory gripping and releasing of those cans.

That small movement of the jaw member is possible since the locus of the can relative to the gripper when travelling from a cell lid into the open gripper is substantially the same as that when travelling from the gripper on to the outfeed conveyor 356, the gripper having inverted itself and the turret rotation having reversed the direction of travel of the can between the moments of gripping the can and subsequently releasing it.

The closed position of the jaw member is adjusted so that the pinch exerted on the electro-coating cans is minimal, and such that no damage is done to the coating newly applied to those cans when the cans are contacted by the said can-contacting lands of the gripper block and jaw member.

On actuation of the gripper operating shaft 696 at a time for opening the gripper, the consequent opening movement of the gripper jaw member 366 relative to the gripper block 708 results in the application of a can-ejecting pressure on the can by the can-ejecting lands 760, so that the can is then moved positively out of contact with the can-contacting lands 718 and falls freely on to the outfeed conveyor. This ensures a prompt release of the can at the time for depositing the can on to that conveyor.

The mode of operation of the apparatus so far described will now be described with reference to the Figures already described above and to the FIGS. 15 and 19.

Figure 15:
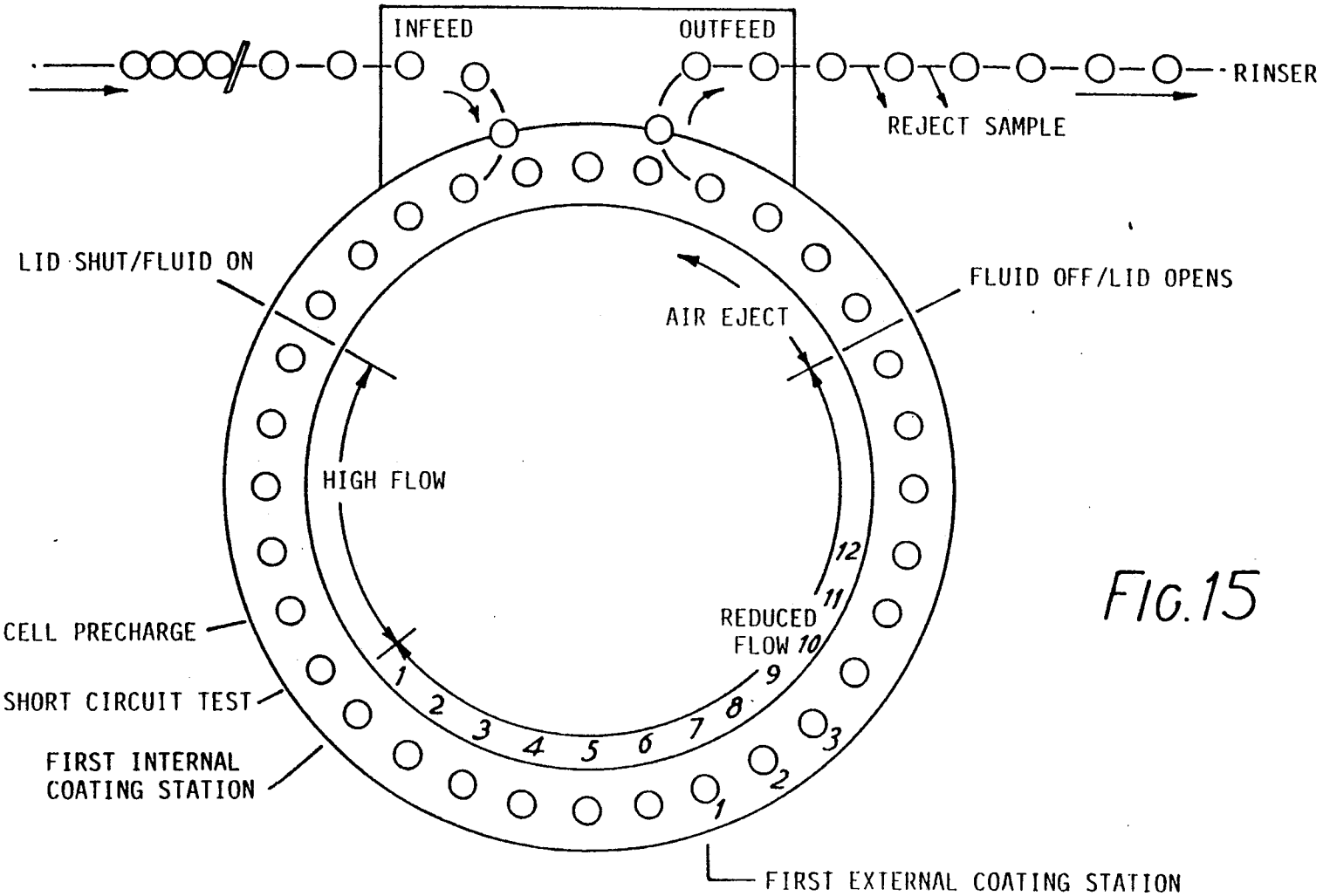
FIG. 15 shows a diagram showing the cycle of events that occurs during one revolution of the turntable.

FIG. 15 shows in relation to a diagrammatic plan view of the rotatable turntable 14 and its electro-coating cells 96, various events that occur during the rotation of the turntable through one revolution, and that cycle of events will now be described below.

FIG. 19 shows schematically in relation to a similar diagrammatic plan view of the turntable the various electrical supply, monitoring and control means and activities that constitute the aforementioned supply and control apparatus 300 and 302.

In operation, the turntable drum 14 and its associated infeed and outfeed devices 326, 328 rotate in synchronism at a constant speed determined by that of the can production/processing line of which the electro-coating apparatus forms part; the pump 66 provides a supply of electro-coating fluid under pressure to the cell supply valve units 214 via the central pipe 68, the associated distribution chamber 70, 72 and the distribution pipes 74; high pressure air is supplied to the interconnected cell closure cylinders 102 via the rotating supply coupling 106, the manifold 108 and the feed pipes 110, so that all of the respective cell lids 100 are urged upwardly towards their upper positions; low pressure air is supplied to the kidney-shaped manifold 314, and thence to the respective supply pipes 202 that are temporarily connected therewith, the associated non-return valves 200 and the cell bodies 94; and the electrical supply source 300 and associated control apparatus 302 for energising the respective brush sets are rendered operative.

Cans are delivered upright, i.e. with base wall lowermost, via a controllable "can-stop" device 400* (see FIG. 19) (for stopping the flow of cans when necessary) to the screw-feed conveyor 338 which spaces the cans apart and delivers them at appropriate intervals to the infeed device 326.

Each can is guided by a can holder (or pocket) 336 of the infeed device in succession past (a) a "can-in" proximity sensor 402* whose function is to signal to the control apparatus 302 the presence of a can 128 in the pocket 336 passing the sensor, and (b) a "pre-weighed can" sensor 404* for sensing marks placed on specific cans which have been weighed before being introduced into the flow of cans, and for signalling to the control apparatus 302 the passage thereby of each such marked can.

On further rotation of the infeed device and turntable, each can is delivered in turn by the associated can pocket 336 to the lowered cell lid 100 then arriving at the infeed station, and is deposited there on to the support pins 126 which project from the can support plate 123. That cell lid is held temporarily in an appropriate lowered position by the static cam 122.

Since each can that is delivered to the infeed station undergoes the same procedure, the progress of one can only will be followed through a typical operating cycle of the turntable 14.

During rotation of the drum unit 14 through one revolution, each of the electro-coating cells 96 and its associated parts are carried round through thirty-two successive, equi-spaced positions or zones relative to the base structure 10. Those positions will be referred to in what follows as "station 1", "stations 2", etc. and as a datum, station 1 will be taken to be the infeed station at which a can to be electro-coated is introduced for enclosure in an electro-coated cell.

During the passage of the cell lid on which the can has been deposited through the next three stations at the height of the static cam 120 progressively reduces, thus allowing the associated cam follower 118 to rise under the pressure of the compressed air supplied to the associated cell closer cylinder 102, and the cell lid to close and seal the associated cell body, thus totally enclosing the can, making electrical contact with it through the can-contacting electrode 162, and holding it firmly on the support pin 126.

A "cell-closed" proximity sensor 406* disposed adjacent the static cam 122 is arranged to detect the presence of each cell closer cam follower wheel 118 at its highest, "cell-closed" position as it passes thereby, and in response to such a presence to supply to said control apparatus 302 a signal indicating that the passing cell is properly closed and ready to receive electro-coating fluid.

The final upward movement of the cell closer also causes the associated push rod 212 to operate the associated poppet valve 218, 220 of the cell supply valve unit 214 and so permit electro-coating fluid to flow rapidly to the cell body 94 via the supply pipe 196, and simultaneously to the can support plate 123 via the non-return valve unit 226, 228 thereby at the same time to completely fill and immerse the can 128 with a rapidly flowing electro-coating fluid.

The fluid continuously leaves the cell, after flowing in contact with one of the surfaces of the can, by way of the exhaust ports 246 and pipes 248, and returns to the reservoir tank 62 for recirculation by the pump 66. At station "5" and a predetermined small group of later stations, the flow of fluid to the cell is at a maximum rate, since the flow to the supply pipe 74 is unimpeded by the larger ports 80 in the cylindrical wall 78 of the baffle 76. The fully immersed condition of the can is reached only after the cell has moved on to another, later station, e.g. station "8".

Figure 13:
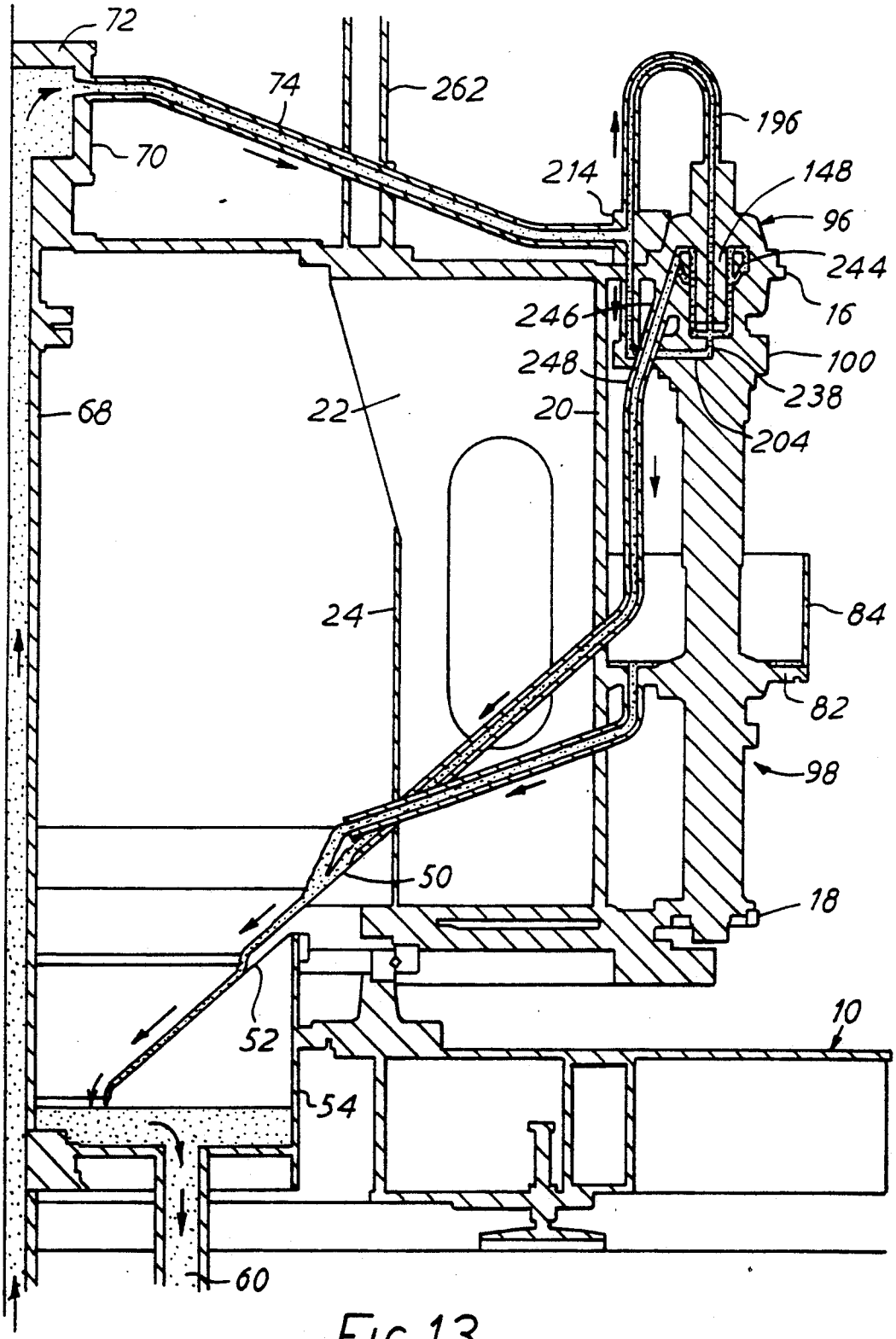
FIG. 13 shows a diagrammatic vertical diametral cross-section of one half of the turntable and indicates thereon the flow path of electro-coating fluid which circulates within the apparatus when in operation.
Figure 14:
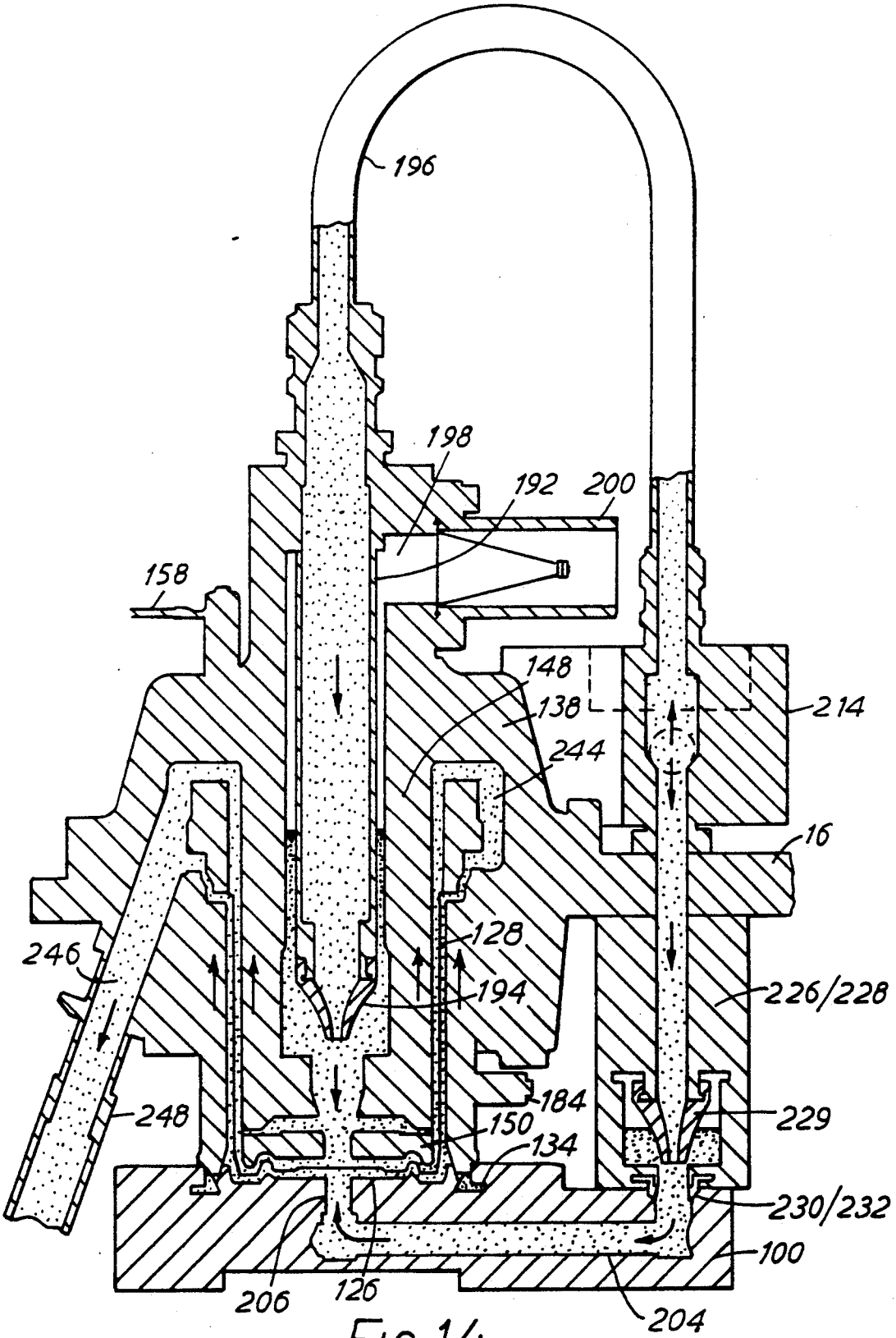
FIG. 14 shows a diagrammatic vertical diametral cross-section through one of the electro-coating cells and indicates thereon the flow path of electro-coating fluid which circulates through the cell during the electro-coating process.

The flow path of the electro-coating fluid after entering the central, vertical supply tube 68 is shown in the FIG. 13, where all of the parts that enclose the flow path are indicated with the same form of cross-hatching, for the sake of simplicity. Likewise, the flow path through an electro-coating cell 96 is shown in greater detail in the FIG. 14, but in this case the various components through which the fluid flows are cross-hatched in appropriately different manners.

When the cell reaches, for example, the station 10, the control and monitoring apparatus 302 associated with the electrical supply source 300 is effective to apply small test voltages between the enclosed can 128 and the internal and external electrodes 148, 176, 123 via the associated slip-ring segments and the brushes associated with that station, whereby to carry out a short circuit test (for instance by observing a loss of charge in a pre-charged cell, or by measuring the circuit resistance between the can and the internal and external electrodes), and to determine from the response thereto whether or not a short circuit exists between the can 128 and either of the internal and external electrodes 148, 176, 123. After completing that test, and signalling to the control apparatus 302 that there is no short circuit present in the closed cell, the electro-coating process can commence, provided that the control apparatus 302 has already received in respect of that cell the other necessary feedback signals indicating that (a) a can is present in the cell, and (b) the cell is properly closed.

At that time, the rate of flow of the fluid through the cell is gradually reduced to a lower value, and remains thereafter at that lower value, by reason of the juxtaposition of a smaller, flow-restricting port 80 in the baffle wall 78 with the port leading to associated cell supply pipe 74.

During the progression of the cell through each in turn of a predetermined group of the later stations, the power supply source 300 (which includes an ON/OFF controlled thyristor bridge rectifier circuit) applies a predetermined d.c. voltage pulse across the requisite brushes of the vertical set associated with the particular station, and hence across the relevant slip-ring segments associated with the cell, so as to pass a direct current pulse between the internal electrode 148 and the can 128, and so cause coating material to be electro-phoretically deposited from the fluid on to the internal surface of the can.

Each such pulse is initiated only when full contact is made between those slip-ring segments and the whole contact areas of the energised brushes, and is terminated just before those slip-ring segments break their full contact with the whole contact areas of those brushes. This ensures that electro-coating current flows for the maximum possible time, and is interrupted for the minimum time interval. For reasons that will be explained later, this is highly beneficial. Moreover, this avoids the possibility of drawings sparks and arcs between the energised brushes and the slip-ring segments on making and breaking electrical contact therebetween. Control of the duration of the voltage pulse may be effected by either a timing circuit synchronised with the turntable rotation, or by a turntable position responsive circuit, the latter being preferred.

Figure 16:
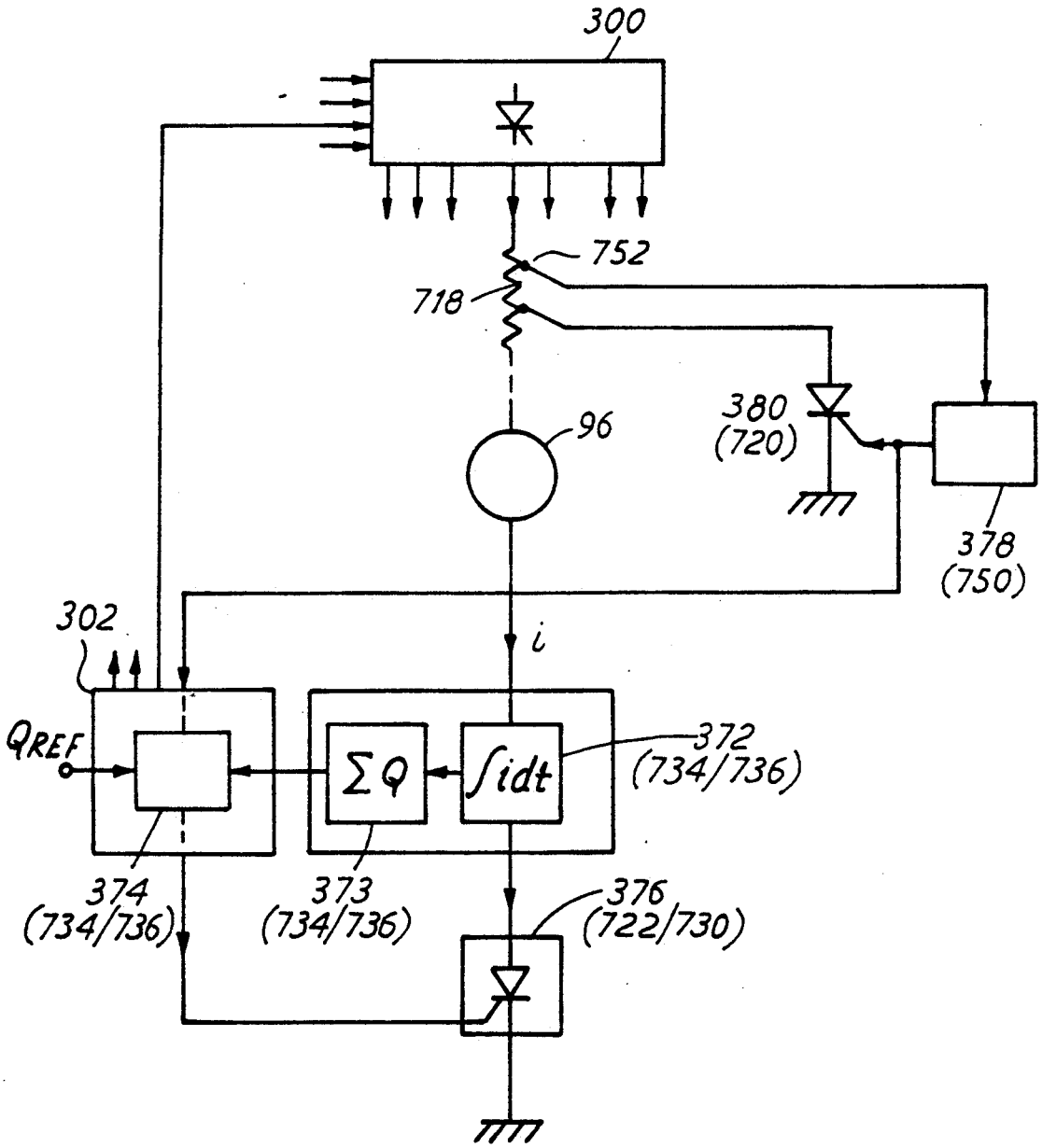
FIG. 16 shows a schematic diagram showing the principal electric circuit components involved in the control of the electro-coating current pulses that are passed through each cell during the process.
Figure 17:
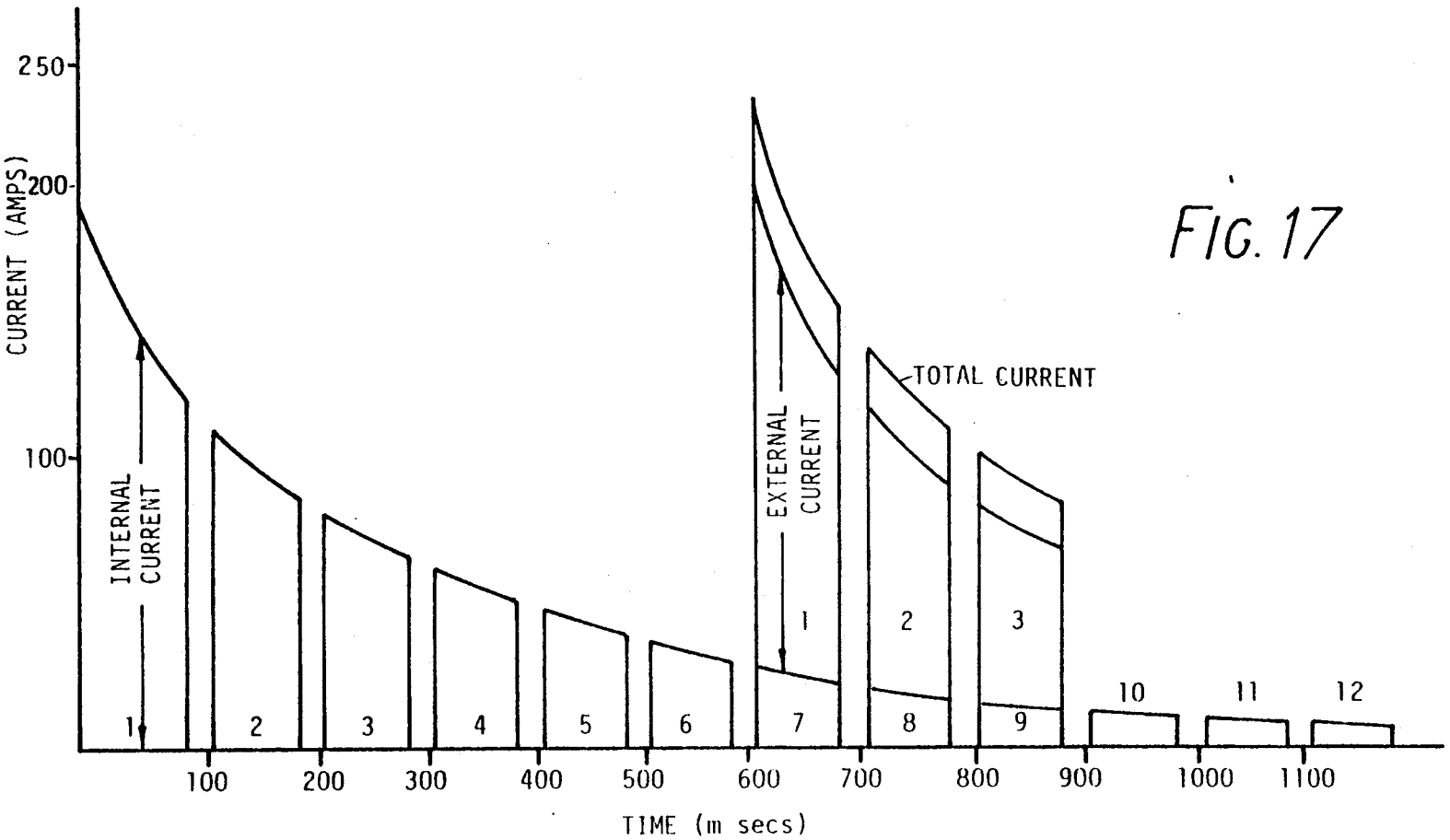
FIG. 17 shows the time sequence of current pulses that are caused to flow in one cell as it is carried through a series of electro-coating stations by rotation of the turntable.

Referring now to the schematic diagram shown in the FIG. 16, the electrical control and monitoring apparatus 302 associated with the supply source 300 includes (a) integrating means 372* for summating the quantity of electrical charge (Coulombs) delivered to the cell during the passage of each such current pulse, (b) summating means 373* for summating at the end of each such pulse the total number of Coulombs delivered so far to the cell in all of the respective pulses; (c) comparison means 374* for comparing with a preset reference value that total charge; and (d) means 376* for inhibiting the delivery of further current pulses to the cell during its further progress through the remaining stations whenever the total number of Coulombs delivered so far exceeds that preset value. By this means, the deposit of the required thickness (or weight) of coating on the interior surface of the can is achieved safely and efficiently, and in the minimum of time, as will be explained later.

The electrical control and monitoring apparatus 302 also includes a cell protection means 378* for sensing from the current and voltage delivered to the cell the onset of a short circuit condition in the cell whilst current is being delivered thereto, and for providing in response to such a sensed condition an output signal for (a) suppressing as rapidly as possible the voltage supplied by the supply source 300 to the cell, and (b) closing without any undue delay a low resistance diverter circuit 380* (referred to later for convenience as a "crowbar" circuit) which is connected directly across the output circuit of the thyristor bridge circuit which supplies the cell circuit. The prompt closure of that diverter circuit before the supply source voltage dies away rapidly reduces to a low value the voltage developed across and hence the current flowing in the cell, so that the risk of causing damage to the cell is minimised.

For determining when the associated vertical set of slip-ring segments is fully in contact with, and is subsequently about to break full contact with, the requisite vertical set of brushes at a particular station, the peripheral part of the annular plate 252 of the slip-ring unit 34 has formed therein a series of equi-spaced, semi-circular notches 382* which correspond with the respective slip-ring segments. Two static proximity detectors 386*, 388* are mounted on the brush carrier plate 282 adjacent the notched peripheral part of the plate 252, and are spaced apart by a dimension which is determined by the sum of (a) the width of a brush 286, (b) the width of the air gaps 389* between adjacent slip-ring segments, and (c) the maximum segment travel that can occur during the switching-off response time. The proximity detectors 386, 388 detect in succession the passage thereby of each notch 382, and supply in response thereto "switch-on" and "switch-off" signals to the control and monitoring apparatus 302 so as to indicate the passage of those notches, and hence of the slip-ring air gaps, relative to the leading and trailing edges of the respective vertical sets of brushes 286.

A third static proximity detector 390* is mounted in the brush carrier plate 282 and is arranged to detect the passage of a datum marker 392* which is secured on the top of the slip-ring carrier plate 252. That detector provides for the control and monitoring apparatus 302 a turntable "zero" or datum signal which in conjunction with the signals provided by the other two detectors 386, 388 enables the control and monitoring apparatus (a) to correctly initiate and terminate the electro-coating current pulses to be supplied to each particular cell during its progression through the respective stations, and (b) to perform its other functions at the various other stations.

If the external surface, as well as the internal surface, of the can is to be electro-coated during the process, the application of the necessary current pulses to the brushes which contact the slip-ring segments of the middle circle 274 is delayed until the cell has moved into, for example, the station 17. The amounts of charge delivered to the external electrodes 176 and 123 are likewise measured and summated at the end of each successive pulse to determine the total charge that has been supplied so far for electro-coating the external surface of the can. Likewise, the applications of any further current pulses to the external electrodes 176, 122 is inhibited when the total charge already supplied at the end of the last pulse exceeds a preset reference value appropriate to the desired thickness and weight of the external coating to be applied.

It will be appreciated that since the magnitude of the successive current pulses supplied to any particular cell decays as the coating process proceeds, initially at a relatively high rate, and then at a progressively decreasing rate, the delaying of the current pulses for providing the external coating until later in the process of providing the internal coating has the effect of reducing the maximum current supplied to the can-contacting electrode 162, and hence of reducing the sizes of the electrical cables and brushgear supplying it. Control apparatus similar to the apparatus 372 to 376 are provided for providing the delayed current pulses for coating the external surface of the cans.

The coating process may proceed, if required, until the cell arrives at the 25th station. As the cell moves from that station to the next, the static cam 120 starts to lower the cam follower 118 (in opposition to the bias force of the cell closer) and hence the cell closer piston rod 114 and its associated cell lid 100 and can 128. The initial downward movement of the cell lid cracks open the cell and allows the escape of fluid from around the outside of the can into a trough formed around the drum unit 14 by the intermediate plate 82 and the inner and outer walls 20, 84.

That movement also withdraws the associated push rod 212 away from the tappet (e.g. 234) of the cell supply valve 214 and so causes the associated poppet valve (e.g. 218) to close and so cut off the supply of electro-coating fluid to the cell. Simultaneously, the associated low pressure air supply port 310 in the brush carrier plate 264 moves under and progresses along the kidney-shaped manifold 314, and thereby allows low pressure air from the manifold to be admitted to the top of the cell body via the supply pipe 202 and the non-return valve 200 during passage of the cell through this and a small group of other stations that lead up to the outfeed station 29.

This low pressure air supply assists in the rapid reduction of the amount of fluid contained in the can, and moreover, provides an air stabilising force for the can sufficient to maintain it stably in position on and in contact with the pins 126 of the cell lid 100 as the cell lid descends to its lower position in readiness for removal of the can.

At the 29th station, the can is engaged gently by a gripper 354 of the outfeed device 328, is removed from the cell lid, and whilst being carried around (by rotation of the outfeed turret 352) by the gripper is rotated through 180° about its transverse axis to empty forwardly the fluid still remaining therein, before being deposited, mouth down, on to the outfeed conveyor 356.

The control and monitoring apparatus 302 is also arranged to make a comparison, after the cell has passed through the final electro-coating station, of the total number of Coulombs supplied to the cell by all of the current pulses delivered during the passage of the cell through the respective electro-coating stations, with a preset reference value, and to provide in the event that the total number of Coulombs does not exceed the reference value a "reject" signal signifying that the can has less than the desired thickness of coating. Such reject signals are used to activate a reject device 408* positioned alongside the outfeed conveyor 356, and so cause it to direct a blast of air at the passing reject can whereby to sweep it off the outfeed conveyor into a reject bin.

The marked pre-weighed cans are likewise swept off the outfeed conveyor at a sample retrieval station by a similarly directed blast of air emitted by a sample retrieval device 410* which is activated by the control apparatus 302 at each instant such a marked can passes thereby.

A further proximity sensor 412* ("can-in") is disposed adjacent the outfeed device 328 at a position just downstream from the delivery point at which cans are deposited by the outfeed device 328 on to the outfeed conveyor 356. That sensor supplies to the control apparatus 302 a signal whenever after a can fails to be deposited on to that conveyor, that can still being carried in a gripper of the outfeed device passes that sensor. Such "can-in" signals are used in the control apparatus to initiate immediately an arrest of the turntable 14 and an interruption of all current flow in the respective cells 96.

An "integrity" check may be carried out (e.g. by an electrical testing means) when each can has passed through all of the electro-coating stations, so as to check the integrity of the deposited coating(s), and to supply to the control apparatus 302 a "fail" signal whenever a can fails that test. Such a signal would give rise to a "reject" signal being delivered to the reject device whereby cause the ejection of the failed can from the outfeed conveyor at the reject station.

The control apparatus 302 includes various shift register means which are executed in advantageous combinations of hardware and software device, and which are indicated in the FIG. 19 by the references 414*, 416* and 418*. Such register means chart the progress of each cell and the condition of a can enclosed therein as the cell is carried along from a position upstream of the can-stop device to a position downstream of the sample station.

The register 414 charts the presence/absence of a can in each cell as the turntable rotates the cells through the respective stations. The register 416 charts for each cell the total charge (in digital form) so far received by the cell in coating the internal surface of the enclosed can. The register 418 similarly charts for each cell the total charge (in digital form) so far received by the cell in coating the external surface of the enclosed can. The respective shift registers are shown as each having sixty-four stages, and as receiving shift pulses from the two proximity sensors 386 and 388 ("cell on" and "cell off"). One such sensor provides control signals which initiate the supply of electro-coating currents to the cells as the respective sets of brushes make full contact with the slip-ring segments just moving into contact with them, and the other such sensor provides control signals which initiate the subsequent interruption of those currents just before the respective sets of brushes break their full contact with the slip-ring segments just moving out of contact with them.

For operating the electro-coating apparatus under a different mode of control, the control apparatus also includes two additional data shift registers 420*, 422* which are similar to the registers 416 and 418 respectively. The register 420 receives from means not shown signals representative of the time periods during which each particular cell has received current in its passage through the respective electro-coating stations for coating the internal surfaces of the cans. That register thus charts in its successive stages the respective totals of the time periods so far elapsed during which each of the respective cells has received current for coating the internal can surfaces. The register 422 similarly receives from means not shown signals representative of the time periods during which each particular cell has received current in its passage through the respective electro-coating stations for coating the external surfaces of the cans. That register thus charts in its successive stages the respective totals of the time periods so far elapsed during which each of the respective cells has received current for coating the external can surfaces.

Thus, the determination of when to cease supplying electro-coating current to each of the respective cells may be made alternatively on the basis of a comparison with (a) a preset reference value which is indicative of the desired value of total charge to be delivered to each cell, or (b) an alternative preset reference value which is indicative of the desired total elapsed time during which current is to flow in each cell. In the former case the data stored in the two registers 416 and 418 is compared with the appropriate reference value (for internal or external coating) of total charge to be delivered, whilst in the latter case the data stored in the two registers 420 and 422 is compared with the appropriate reference value (for internal or external coating) of the elapsed time during which current is to flow in each cell.

In this latter case (total elapsed time basis), the apparatus operates to ensure that each cell receives current (at a level which is intended to deliver the desired coating during the reference value of elapsed time), and to reject any coated can that in a comparison carried out at the end of the electro-coating process with a further reference value (indicative of the desired Coulomb count for achieving the desired coating) is found to have received less than the Coulomb count necessary for achieving the desired weight of deposited coating material.

If desired, the low pressure air supply may be connected via the manifold 314 and the pipe 202 with a cell 96 during its passage through one or more stations immediately after a can has been deposited on its cell lid 100 at the infeed station, for the purpose of stabilising that can in position on the cell lid.

Logging in a micro-processor the various reject signals, together with the identities of the cells in which the rejected cans were coated, enables the operator of the apparatus to determine which particular cells may be in need of attention or replacement.

The provision of the two non-return fluid valves 194 and 226/228 in the respective fluid paths feeding the interior and the exterior of the can provides the advantage that when the cell is opened at the end of the electro-coating process a large volume of the electro-coating fluid is trapped between those two valves and is thus conserved for use during the next electro-coating cycle. This has a considerable and beneficial influence on the capacity and rating of the fluid circulation pump 66, and moreover, reduces the time required to fill the cell.

The interconnection of the cylinders 102 of all of the cell closers 98 in a ring system enables the demand for high pressure air to be minimised, since air being expelled from cylinders as they approach the outfeed station is taken up by cylinders just leaving the infeed station.

ELECTRICAL CIRCUIT AND CONTROL APPARATUS

An electrical circuit and control apparatus for giving effect to the above described mode of operation will now be described, after a brief discussion of a prior art control technique and circuit of which the present invention is an improvement.

In our patent specification GB 2,085,922 B (to which the reader's attention is hereby directed for further information concerning its disclosure), we disclosed an electro-coating apparatus in which can bodies were successively enclosed in respective cells carried in circular formation around a rotating turntable. The electrode systems of those cells were electrically energised successively as they were carried round by the turntable through successive electro-coating stations, so as to cause three successive depositions of electro-coating material on to the interior surface of each can body from an electro-coating fluid flowing in contact with that surface.

At each of those successive stations, a stationary pair of brushes engaged successive pairs of slip-ring segments carried by the turntable as they passed by on rotation of the turntable, thus energising successively the cell electrode systems that were electrically associated with the respective pairs of slip-ring segments, each cell having its electrode system connected in series between the respective segments of one of said segment pair.

The applications of a common d.c. voltage across the three sets of brushes thus resulted in three successive energisations of each cell electrode system. Electronic switches placed in series with the respective circuits supplying the respective brush pairs enabled independent switching on or off of the voltage applied to the respective brush pairs, and thus independent control of the electro-coating process in the respective stations and in the respective cells.

Synchronising means ensured that the application of voltage to the respective brush pairs occurred only after the respective brush pairs were fully in contact with the respective segment pairs which had just moved into electrical contact with them.

The timing control means also ensured that the voltage applied to the respective brush pairs was terminated at the end of a predetermined, fixed time period such that with the turntable running at its maximum speed, the flow of electro-coating current through the respective brush pairs was terminated before full contact of the respective brush pairs was broken, so as to prevent sparking and arcing at the brush/segment interface.

As a consequence of that form of current control, whenever the turntable was operated at a speed lower than the maximum value, the electro-coating current flow ceased in advance of the instant of breaking full brush/segment contact, with the result that the interval between the termination of one current pulse and the beginning of the next current pulse in that cell increased with decrease in the turntable speed.

Figure 20:
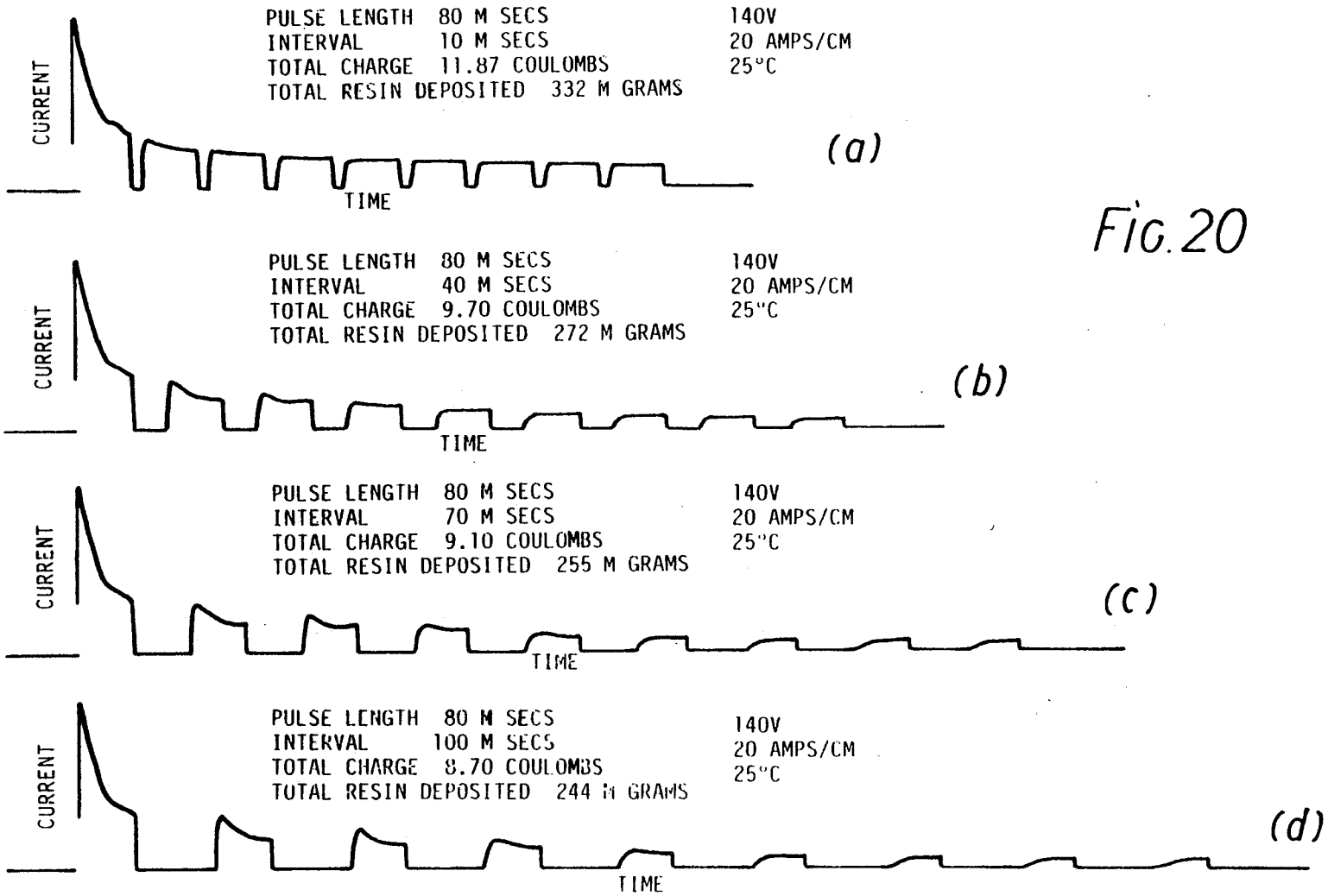
FIG. 20 indicates a series of graphs which relate electro-coating current and time, the respective graphs (*a*) to (*d*) demonstrating the adverse effect on the electro-coating process of increasing the duration of the time intervals between successive current pulses.

This system of electro-coating current control (and of rejecting cans having an unsatisfactory coating by means of a comparison against a reference Coulomb count of the actual Coulomb quantity delivered) has been found to be disadvantageous, since the deposit of electro-coating material was found to fall progressively with reduction in turntable speed despite the fact that the duration and number of current pulses passing through each cell remained constant. This is illustrated in the FIG. 20, where the graphs (a) to (d) show the effect of increasing the current pulse interval whilst maintaining the other pulse and cell parameter values constant.

In those Figures, current pulses of constant magnitude and constant duration of 80 msecs were spaced apart by different pulse intervals of 10, 40, 70 and 100 msecs respectively. As the pulse interval increased in the different examples, the total charge delivered to the electro-coating cell decreased from 11.87 to 9.7, 9.1, and 8.7 Coulombs respectively, and the deposits of electro-coating material fell from 332 mg to 272, 255 and 244 mg respectively. Those figures were obtained during the coating of an epoxy based material on to 33 centiliter DWI (drawn and wall-ironed) tinplate beverage cans.

Those Figures show (a) that during each current pulse the current magnitude falls progressively as the resistance of the film of deposited material increases due to the progressively increasing the thickening coverage of the can body; and (b) that with short intervals, the rise of current at the start of each pulse is relatively rapid, whereas with longer intervals, that rise of current is relatively slow. This slower rise in current is believed to result from an increase in the resistance of the deposited film during the interpulse period; the longer that period, the greater the change in resistance.

Likewise, it is believed that whereas during the passage of a current pulse the film of material deposited on the can body surface remains fairly "open" so as to allow movement of the ionic species of dissociated water and gas ($O_2$), during the current interval some rearrangement takes place within the deposited film so that a more closely-packed and hence more resistive film is formed: the greater the pulse interval, the more closely packed the film becomes. Hence, it has become clear to us that the pulse interval should be kept as small as possible.

Furthermore, it is believed that the phenomenon described above applied equally in respect of both anodically and cathodically deposited materials (e.g. acrylic, polyester, epoxy-acrylic types of electro-coating materials), applied to a variety of different substrates (e.g., aluminium, steel, tinplate), at temperatures up to 30° C., and using voltages up to 250 volts.

Thus, as has been referred to in the abovementioned fourth aspect of the present invention, no such fixed duration of the current pulses is employed, but instead, each current pulse is allowed to continue, after full brush/segment contact has been established, until that full brush/segment contact is about to be interrupted. One convenient way of achieving that is to employ position sensing means arranged to detect the angular position of the turntable relative to a datum, and to produce switching-on control signal pulses at the instants when full brush/segment contacts have just been established, and switching-off control signals when the continuance of those full contacts is about to cease. Such a sensing means may comprise, for example, two sensors arranged to detect in succession the passage of each one of a series of notches spaced around the turntable at the angular pitch of the electro-coating cells.

Thus, with such arrangements according to the present invention, the pulse duration is always at the maximum value possible, and the pulse interval is always at the minimum value possible, for the particular turntable speed, since the whole period of full brush/segment contact is utilised; and the ratio of the pulse duration to the pulse interval is always constant, regardless of the turntable speed. Since the pulse duration is now dependent on the turntable speed, and falls with increase in that speed, the desired deposit of electro-coating material will occur in a different spread of time periods according to that speed.

Thus, according to another feature of this fourth aspect of the present invention, (a) the amounts of electrical charge (Coulombs) delivered to each individual cell at the respective stations are measured and summated to produce a control signal which is representative of the total charge delivered so far to that cell by the respective currents that have already passed through it; (b) that signal is compared repeatedly with a predetermined reference signal representative of the desired deposit of electro-coating material; and (c) an inhibit signal is produced whenever that total charge signal exceeds the reference signal, which inhibit signal is used to inhibit the delivery of further current pulses to that cell as it passes through subsequent stations.

By this means, the deposit of a desired amount of material is successively achieved regardless of the turntable speed, since at lower speeds, the longer duration pulses cause an earlier production of an inhibit signal, after but a few long duration pulses, whilst at higher speeds the shorter duration of the current pulses necessitates a larger number of pulses in order to deposit the same amount of material. Furthermore, more precise control of the amount of material deposited is possible since the termination of current flow in any particular cell is initiated at a station at which the deposit has been completed.

Figure 18:
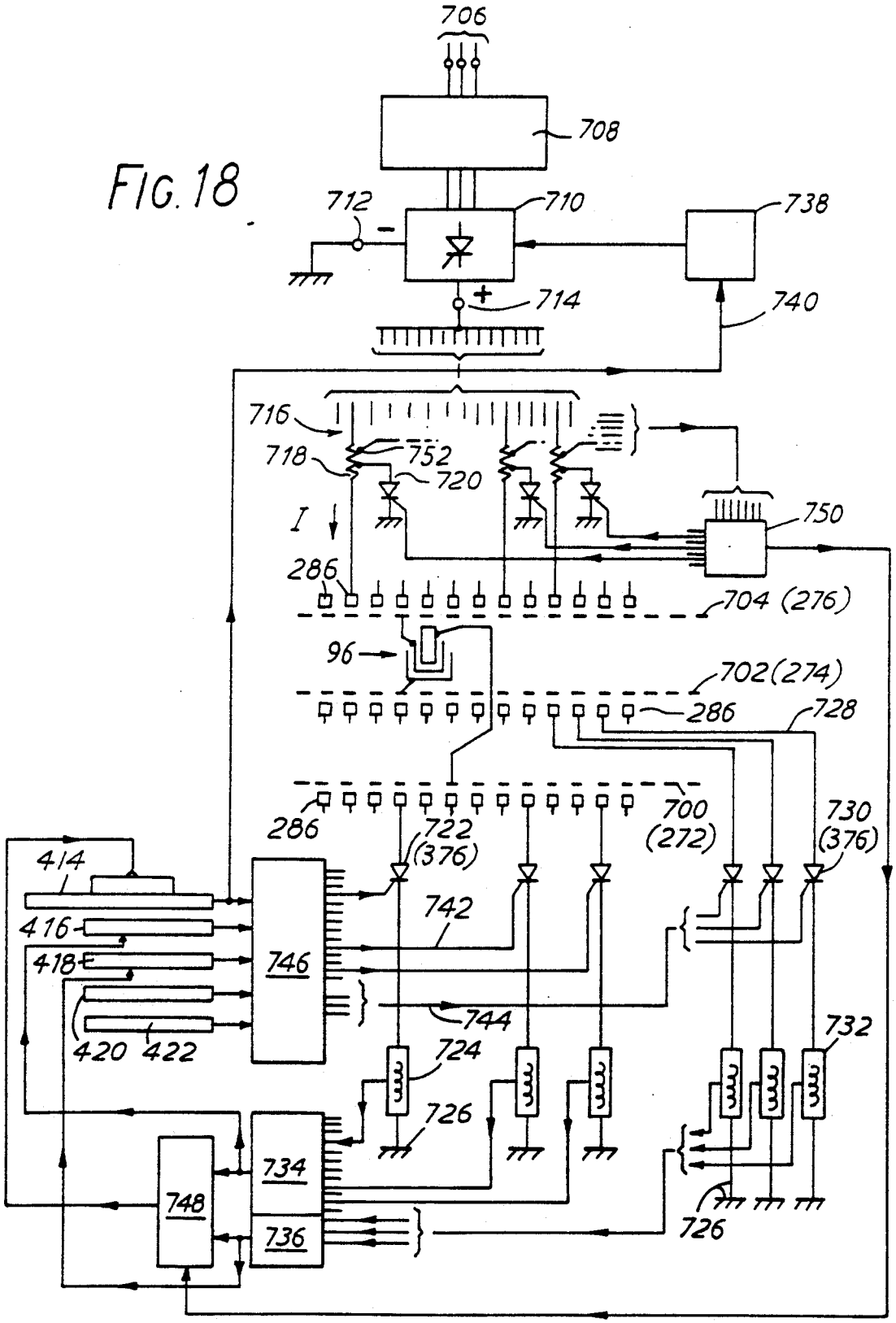
FIG. 18 shows an electric circuit diagram of the apparatus.

Referring now to the schematic diagrams shown in the FIGS. 18 and 19.

FIGS. 18 shows the main circuits (including those of the power supply unit 300 and the control and monitoring apparatus 302) for supplying and controlling the electro-coating current flows through the respective cells of the apparatus. The respective rings 272 and 276 of slip-ring segments 278 are represented there for simplicity's sake by the parallel straight lines of dashes 700*, 702*, 704*, each dash representing one segment 278, and the cooperating brushes 286 are shown adjacent those lines of dashes.

The electro-coating direct current pulses are derived from a three-phase a.c. supply source 706* via a variable voltage transformer 708* and a hybrid thyristor rectifier bridge circuit 710* having its negative terminal 712* connected to earth, and its positive terminal 714* connected to twelve similar parallel-connected electro-coating circuits 716*.

Each such circuit 716 comprises, in serial connection, a current limiting/short-circuit detecting resistor 718* having a centre tapping thereof connected via a "crowbar" cell-short-circuiting thyristor (SCR) 720* to earth, a brush 286 contacting the ring of slip-ring segments 276 (connected to the respective cans 128), the can 128 and the internal electrode 148 of an electro-coating cell 96 enclosing the can, a brush 286 contacting the ring of slip-ring segments 272 (connected with the internal electrodes 148 of the cells), an electronic selector 722* constituted by a thyristor, a d.c. current transformer (DCCT) 724*, and an earth return connection 726*.

A group of three brushes 286 which make contact with the ring of slip-ring segments 274 connected with the respective cell external electrodes 176, 123 are each connected to an earth connection 726 through respective similar circuits 728*, each of which likewise includes in series an electronic selector switch 730* constituted by a thyristor and a d.c. current transformer 732*.

The DCCTs 724, 732 supply current signals to respective "Coulomb processing" means 734*, 736*, each of which incorporates an integrating means (not shown) for integrating (with respect to time) the associated DCCT output signal so as to produce as its output signal a digital, "Coulomb" signal representing the charge delivered by the electro-coating current flowing in the associated cell electrode system.

The magnitude of the electro-coating currents supplied to the cells is controlled by adjustment of the output voltage of the variable voltage transformer 708.

The thyristor rectifier bridge 710 is controlled in an ON/OFF manner by a bridge control circuit 738* which receives control signals via a control circuit 740*.

Energisation of the respective electrode systems in the respective cells is achieved by selective energisation of the selector thyristor switches 722, 730, as determined by the presence/absence of firing control signals at the respective output circuits 742*, 744* of a cell selecting control circuit 746*.

The control circuit 746 derives its input control signals from the output circuits of the respective shift registers 414 to 422, which registers derive input signals data from the "Coulomb processing" means/package 734/736.

Other data is supplied to those registers via an "over-current and crowbar signal processing" means/package 748* which receives input signals from the "Coulomb processing" means/package 734, 736, and from a "crowbar" control circuit 750*. That processing means 748 determines from the signals and data supplied thereto, and supplies to the shift register 414, the identity of a cell in which an over-current and/or a short circuit has developed.

The crowbar thyristors 720 are controlled by a crowbar control circuit 750* which derives its respective input signals, indicative of excessive magnitudes of the respective electro-coating currents, from respective tappings 752* on the respective current limiting resistors 718.

In the schematic diagram of the FIG. 19, the power and control circuits of FIG. 18 are shown in a different format and in conjunction with (a) a representation, in plan view, of the rotatable turntable 14 and its associated electro-coating cells 96 and control devices.

The digital data shift registers and other data processing means referred to above may be incorporated in a microprocessor of any suitable conventional kind, for example, a processor known as a "MAC 85" processor, and the respective processing means/packages may be constituted as any appropriate combination of hardware and software means. Wherever appropriate, the various items shown in this Figure bear the reference assigned to them earlier in this description.

We claim:

1. Electro-coating apparatus for electro-coating a surface of an open-ended hollow container which includes a base wall and an annular side wall comprising:

(a) a rotatable turntable;

(b) at least one fluid-tight electro-coating cell carried on the turntable and comprising two separable, vertically-aligned cooperating cell parts, said cell parts including a static cell part statically carried on the turntable and a movable cell part movably carried on the turntable for movement to and from a closed position in which the cell parts form the fluid-tight cell; one of the cell parts comprising a hollow cell body having a lowermost open end for receiving vertically therethrough said container, and the other of the cell parts comprising a cell lid for closing said open end of the cell body thereby to enclose in the cell the container when carried on the cell lid;

(c) an actuator carried on the turntable and being connected with the movable cell part thereby on activation of the actuator to effect vertical movement of the movable cell part relative to the static cell part;

(d) fluid supply conduit means connected with the cell body and adapted to connect the cell body with a source of pressurized electro-coating fluid thereby to permit the flow of the electro-coating fluid to the cell when closed;

(e) fluid exit conduit means connected with the cell body to permit the flow of electro-coating fluid from the cell after flowing therethrough;

(f) at least two electrodes carried in the cell body for effecting, when electrically energized, electro-coating of the container enclosed in the cell; and (g) electric supply cables connected with the electrodes for applying an electro-coating potential therebetween; and in which apparatus:

(i) the static cell part comprises the cell body;

(ii) the actuator is coupled to and effects movement of the cell lid;

(iii) a fluid collection trough is carried on the turntable below the cell lid thereby to receive electro-coating fluid released from the cell when the cell lid is separated from the open end of the cell body by the actuator;

(v) the actuator comprises (a) an actuating mechanism carried on the turntable below the fluid collection trough, and (b) an actuating member which carries at its lower end a cam follower and extends upwards through the fluid collection trough in a fluid-tight manner; and said actuating member carries at its upper end the cell lid;

(v) said fluid supply conduit means and said electric supply cables extend upwards from the cell body to respective supply sources disposed above the cell body; and (vi) a fluid draining conduit means is connected with the fluid collection trough and is adapted to drain fluid collected in the fluid collection trough under gravity to a fluid reservoir for recirculation to the fluid supply source.

2. Apparatus according to claim 1 wherein the cell body incorporates a fluid delivery tube connected to said fluid supply conduit means, said delivery tube has a lower free end disposed and adapted to deliver electro-coating fluid directly into the lower part of the container enclosed in the cell and then flow radially outwards over the base wall of the container and then vertically upwards over the side wall of the container to said fluid exit conduit means, and wherein said delivery tube carries at its lower free end a normally-closed, pressure-activated, non-return valve adapted to open automatically in response to a fluid pressure from said supply source thereby to deliver fluid into the container, and to close again automatically when said fluid pressure ceases, thereby to terminate automatically the flow of electro-coating fluid into the container, and thereby minimize the loss of fluid on the descent of the cell lid to open the cell and lower the container out of the cell body.

3. Apparatus according to claim 2 wherein the cell body includes an air delivery duct disposed and arranged to deliver air under pressure to the lower part of the container enclosed in the cell thereby to expel electro-coating fluid in the container via said fluid exit conduit means, and a non-return valve connected in said duct and adapted to permit the passage of pressurized air into the cell body, but to prevent the escape therethrough of electro-coating fluid, and including a pressurized-air conduit means connected with said duct and extending upwardly to a source of pressurized air.

4. Apparatus according to claim 1 wherein said fluid supply conduit means includes a normally-closed fluid supply valve carried on the turntable adjacent the cell body, and the cell lid incorporates a valve operating member which is disposed and adapted to open the fluid supply valve when the cell lid moves into a position in which it closes the cell body in a fluid-tight manner, thereby to ensure that the flow of electro-coating fluid commences only on closure of the cell body, and terminates on the initial descent of the cell lid.

5. Apparatus according to claim 1 wherein one said electrode comprises a tubular electrode adapted to enter into the container with clearance from the side and base walls thereof, thereby to effect electro-coating of the internal surface of the container, which electrode has at a lower free end thereof an end surface which conforms with clearance to the profile of the base wall of the container.

6. Apparatus according to claim 5 wherein said tubular electrode has adjacent its said lower end a plurality of radial ports for radially directing electro-coating fluid towards the side wall of the container.

7. Apparatus according to claim 5 wherein the other of the two electrodes is disposed and adapted to make electrical contact with a rim part of the container at the end thereof remote from the base wall.

8. Apparatus according to claim 7 including a third electrode carried in the cell body and arranged to encircle the container side wall with clearance therefrom, and a third electric supply cable connected with the third electrode for supplying thereto an electro-coating potential, thereby to effect electro-coating of the external surface of the container side wall, said third supply cable extending upwards to said supply source.

9. Apparatus according to claim 5 wherein the cell lid includes a fluid delivery passage adapted to direct electro-coating fluid against the external surface of the container base wall, and wherein said fluid supply conduit means is also connected with that fluid delivery passage.

10. Apparatus according to claim 9 including a fourth electrode carried in the cell lid and disposed adjacent but spaced from the base wall of the container seated on the cell lid, and a fourth electric supply cable connected with the fourth electrode for supplying thereto an electro-coating potential, thereby to effect electro-coating of the external surface of the container base wall, said fourth supply cable extending upwards to said supply source.

11. Apparatus according to claim 9 wherein (a) said fluid delivery passage is connected with the fluid supply conduit means via a normally-closed fluid supply valve carried on the turntable adjacent the cell body, (b) said fluid supply valve and fluid delivery passage communicate with one another when the cell lid is in position closing the open end of the cell body via cooperating, separable, male and female connection parts, which parts are carried on the turntable and cell lid respectively; and (c) the cell lid incorporates a valve operating member which is disposed and adapted to open the fluid supply valve when the cell lid moves into a position in which it closes the cell body in a fluid-tight manner, thereby to ensure that the flow of electro-coating fluid to the cell lid commences only on closure of the cell body by the cell lid, and terminates on the initial descent of the cell lid.

12. Apparatus according to claim 11 including connected between said normally-closed fluid supply valve and the associated said connection part, a normally-closed, pressure-activated, non-return valve adapted to open automatically in response to a fluid pressure from said supply source thereby to delivery fluid to the cell lid, and to close again automatically when said fluid pressure ceases, thereby to terminate automatically the flow of electro-coating fluid to the cell lid, and thereby minimize the loss of fluid on the descent of the cell lid to open the cell and lower the container out of the cell body.

13. Apparatus according to claim 1 including a container outfeed device, which device includes:

(a) a container gripping means having jaw member arranged when in a closed condition to grip the container side wall and when in the open condition to release the container;

(b) jar operating means coupled with the jaw members and arranged for operating them between closed and open conditions in which they grip and release the container respectively;

(c) driving means coupled with the gripping means for driving the gripping means transversely relative to the vertical motion of the container when carried on the cell lid, thereby to move the gripping means into and through a position in which the jaw member may be operated to grip the container when it is descending on the cell lid;

(d) first synchronizing means for synchronizing operation of the driving means with the cell lid actuating means so as to bring the gripping means to said position only after the container has descended to a level in which it lies clear of the cell body; and (e) second synchronizing means for synchronizing operation of the jaw operation means with the driving means so as to cause the jaw members to close around the container as it descends on the cell lid only when the gripping means occupies the said position.

14. Apparatus according to claim 13 wherein the gripping means is carried for rotation on a shaft, and wherein said driving means is arranged to rotate the shaft and invert the container after the gripping means has gripped the container and moved it beyond the said position, thereby to empty from the container electro-coating fluid contained therein into the fluid collection trough.

15. Electro-coating apparatus for electro-coating a surface of an open-ended hollow container which includes a base wall and an annular side wall comprising:

(a) a rotatable turntable;

(b) at least one fluid-tight electro-coating cell carried on the turntable and comprising two separable, vertically-aligned cooperating cell parts, said cell parts including a static cell part statically carried on the turntable and a movable cell part movably carried on the turntable for movement to and from a closed position in which the cell parts form the fluid-tight cell; one of the cell parts comprising a hollow cell body having a lowermost open end for receiving vertically therethrough said container, and the other of the cell parts comprising a cell lid for closing said open end of the cell body thereby to enclose in the cell the container when carried on the lid;

(c) an actuator carried on the turntable and being connected with the movable cell part thereby on activation of the actuator to effect vertical movement of the movable cell part relative to the static cell part;

(d) fluid supply conduit means connected with the cell body and adapted to connect the cell body with a source of pressurized electro-coating fluid thereby to permit the flow of the electro-coating fluid to the cell when closed;

(e) fluid exit conduit means connected with the cell body to permit the flow of electro-coating fluid from the cell after flowing therethrough;

(f) at least two electrodes carried in the cell body for effecting, when electrically energized, electro-coating of the container enclosed in the cell; and (g) electric supply cables connected with the electrodes for applying an electro-coating potential therebetween:

(i) the static cell part comprises the cell body;

(ii) the actuator is coupled to and effects movement of the cell lid; and (iii) there is provided a container outfeed device which includes:

(a) a container gripping means having jaw members arranged when in closed condition to grip the container side wall and when in the open condition to release the container;

(b) jar operating means coupled with the jaw members and arranged for operating them between closed and open conditions in which they grip and release the container respectively;

(c) driving means coupled with the gripping means for driving the gripping means transversely relative to the vertical motion of the container when carried on the cell lid, thereby to move the gripping means into and through a position in which the jaw members may be operated to grip the container when it is descending on the cell lid;

(d) first synchronizing means for synchronizing operation of the driving means with the cell lid actuating means so as to bring the gripping means to said position only after the container has descended to a level in which it lies clear of the cell body; and (e) second synchronizing means for synchronizing operation of the jaw operating means with the driving means so as to cause the jaw members to close around the container as it descends on the cell lid only when the gripping means occupies the said position.

16. Apparatus according to claim 15 wherein the gripping means is carried for rotation on a shaft, and wherein said driving means is arranged to rotate the shaft and invert the container after the gripping means has gripped the container and moved it beyond the said position.

17. Electro-coating apparatus for electro-coating a surface of an open-ended hollow container which includes a base wall and an annular side wall comprising:

(a) a rotatable turntable;

(b) at least one fluid-tight electro-coating cell carried on the turntable and comprising two separable, vertically-aligned cooperating cell parts, said cell parts including a static cell part statically carried on the turntable and a movable cell part movably carried on the turntable for movement to and from a closed position in which the cell parts form the fluid-tight cell; one of the cell parts comprising a hollow cell body having a central tubular member and a lowermost open end for receiving vertically therethrough said container with its open end engaged with radial clearance around the central tubular member, and the other of the cell parts comprising a cell lid for closing said open end of the cell body thereby to enclose in the cell the container when carried on the cell lid;

(c) an actuator carried on the turntable and being connected with the movable cell part thereby on activation of the actuator to effect vertical movement of the movable cell part relative to the static cell part;

(d) fluid supply conduit means connected with the cell body and adapted to connect the cell body with a source of pressurized electro-coating fluid thereby to permit the flow of the electro-coating fluid to the cell when closed;

(e) fluid exit conduit means connected with the cell body to permit the flow of electro-coating fluid from the cell after flowing therethrough and while the cell is closed; and (f) at least two electrodes carried in the cell body for effecting, when electrically energized, electro-coating of the container enclosed in the cell; and being further characterized in that:

(i) the cell body is fixed to an annular plate (16) of the turntable with the open end of the cell lowermost and disposed below said annular plates;

(ii) the cell lid is supported on the actuator for lifting to close the cell and lowering to open the cell;

(iii) a fluid collection trough is carried by the turntable below the cell body and cell lid thereby to receive electro-coating fluid released from the cell when the cell is opened, said trough being covered at the top by said annular plate of the turntable; and (iv) said actuator extends through the trough to cooperate with cam means located below the trough.

18. Electro-coating apparatus for electro-coating a surface of an open-ended hollow container which includes a base wall and an annular side wall comprising:

(a) a rotatable turntable;

(b) at least one fluid-tight electro-coating cell carried on the turntable and comprising two separable, vertically-aligned cooperating cell parts, said cell parts including a static cell part statically carried on the turntable and a movable cell part movably carried on the turntable for movement to and from a closed position in which the cell parts form the fluid-tight cell; one of the cell parts comprising a hollow cell body having a central tubular member and a lowermost open end for receiving vertically therethrough said container with its open end engaged with radial clearance around the central tubular member, and the other of the cell parts comprising a cell lid for closing said open end of the cell body thereby to enclose in the cell the container when carried on the cell lid;

(c) an actuator carried on the turntable and being connected with the movable cell part thereby on activation of the actuator to effect vertical movement of the movable cell part relative to the static cell part;

(d) fluid supply conduit means connected with the cell body and adapted to connect the cell body with a source of pressurized electro-coating fluid thereby to permit the flow of the electro-coating fluid to the cell when closed;

(e) fluid exit conduit means connected with the cell body to permit the flow of electro-coating fluid from the cell after flowing therethrough and while the cell is closed; and (f) at least two electrodes carried in the cell body for effecting, when electrically energized, electro-coating of the container enclosed in the cell; and being further characterized in that:

(i) the cell body is fixed to the turntable with its open end lowermost and above the cell lid;

(ii) the cell lid is supported on the actuator for lifting to close the cell and lowering to open the cell; and (iii) said fluid supply conduit means extends from above downwardly to both said central tubular member and said cell lid thereby to cause said fluid to rise in said cell towards said open end of said container and thus simultaneously fill and surround said container.

19. Apparatus according to claim 18 including in an upper portion of the cell body an annular fluid gallery (244) for receiving said fluid on rising interiorly and exteriorly to the uppermost open end of said container, and said gallery being disposed exteriorly of said container and having exit duct means (246) for conducting said fluid from said annular fluid gallery to said fluid exit conduit means (248) while said cell is closed.

* * * * *